US010438518B2

(12) United States Patent
Banno et al.

(10) Patent No.: US 10,438,518 B2
(45) Date of Patent: Oct. 8, 2019

(54) LABEL MEDIUM AND CASSETTE

(71) Applicant: Brother Kogyo Kabushiki Kaisha, Nagoya-shi, Aichi-ken (JP)

(72) Inventors: Takaaki Banno, Nagoya (JP); Yukiko Takami, Inazawa (JP); Harumitsu Inoue, Toki (JP); Haruki Matsumoto, Nagoya (JP); Yukihiko Sato, Nagoya (JP); Shino Maeda, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/896,191

(22) Filed: Feb. 14, 2018

(65) Prior Publication Data

US 2019/0005853 A1 Jan. 3, 2019

(30) Foreign Application Priority Data

Jun. 30, 2017 (JP) ..... 2017-129487

(51) Int. Cl.
*G09F 3/20* (2006.01)
*G09F 3/00* (2006.01)
(Continued)

(52) U.S. Cl.
CPC ..... *G09F 3/205* (2013.01); *B41J 15/044* (2013.01); *G09F 3/00* (2013.01); *G09F 3/02* (2013.01);
(Continued)

(58) Field of Classification Search
CPC ..... G09F 2003/0201; G09F 2003/0251; G09F 2003/0254; G09F 2003/0266;
(Continued)

(56) References Cited

U.S. PATENT DOCUMENTS 280,086 A * 6/1883 Scharnweber ..... G09F 3/037 292/315
2,642,684 A * 6/1953 Watts ..... G09F 3/04 40/669
(Continued)

FOREIGN PATENT DOCUMENTS

DE 202004003107 U1 4/2004
EP 2833341 A1 2/2015
(Continued)

OTHER PUBLICATIONS

Feb. 14, 2019—(EP) Extended Search Report—App 18160624.5.
(Continued)

*Primary Examiner* — David R Dunn
*Assistant Examiner* — Christopher E Veraa
(74) *Attorney, Agent, or Firm* — Banner & Witcoff, Ltd.

(57) ABSTRACT

A label medium includes a label including: information-printable first and second indicator portions; first and second wrapping portions; a first through portion having at least a portion of a first hole or a first slit; and a second through portion having at least a portion of a second hole or a second slit. The first indicator portion, the first wrapping portion, and the first through portion are arranged in this order in a first direction. The second indicator portion, the second wrapping portion, and the second through portion are arranged in this order in one of the first direction or a second direction. The first indicator portion and the second indicator portion are at least connected to each other via a line. The first hole or the first slit and the second hole or the second slit are at least partly symmetric with respect to the imaginary line.

38 Claims, 11 Drawing Sheets

(51) Int. Cl.
*G09F 3/04* (2006.01)
*B41J 15/04* (2006.01)
*G09F 3/02* (2006.01)

(52) U.S. Cl.
CPC ..... *G09F 3/0286* (2013.01); *G09F 3/0295* (2013.01); *G09F 3/04* (2013.01); *G09F 3/20* (2013.01); *G09F 2003/0201* (2013.01); *G09F 2003/0251* (2013.01); *G09F 2003/0266* (2013.01); *G09F 2003/0269* (2013.01)

(58) Field of Classification Search
CPC ..... G09F 2003/0269; G09F 3/0206; G09F 3/0295; G09F 3/0311; G09F 3/037; G09F 3/205; G09F 3/206
See application file for complete search history.

(56) References Cited

U.S. PATENT DOCUMENTS 3,197,830 A * 8/1965 Hoadley ..... F16L 3/233 24/16 PB
3,757,936 A * 9/1973 Lindegren ..... B65D 83/08 206/527
4,004,362 A * 1/1977 Barbieri ..... G09F 3/10 174/112
4,916,841 A * 4/1990 Dawson ..... G09F 3/10 40/6
5,145,211 A * 9/1992 McKillip ..... G09F 3/0288 283/105
5,381,617 A * 1/1995 Schwartztol ..... G09F 3/14 40/6
8,074,389 B2 12/2011 Greer et al.
9,355,577 B1 * 5/2016 Coleman ..... G09F 3/02
9,539,832 B2 1/2017 Sasaki
2004/0068906 A1 4/2004 Riley
2004/0194360 A1 * 10/2004 McCabe ..... G09F 3/14 40/316
2004/0237368 A1 * 12/2004 Paskesen ..... G09F 3/206 40/645
2005/0126701 A1 * 6/2005 Hodsdon ..... G09F 3/0286 156/289
2005/0204594 A1 * 9/2005 Savagian ..... G09F 3/0295 40/316
2005/0268435 A1 * 12/2005 Moughelbay ..... A01G 17/12 24/16 PB
2005/0279001 A1 12/2005 Riley
2006/0057325 A1 * 3/2006 Hodsdon ..... G09F 3/0286 428/40.1
2008/0120881 A1 * 5/2008 Rhinehart ..... A45F 5/10 40/665
2008/0301981 A1 * 12/2008 Giro Amigo ..... G09F 3/0295 40/299.01
2010/0281724 A1 11/2010 Greer et al.
2010/0313454 A1 * 12/2010 Smith, Jr. ..... G09F 3/0295 40/316
2013/0180138 A1 * 7/2013 Luea ..... G09F 3/04 40/306
2013/0260991 A1 * 10/2013 Van Boom ..... B31D 1/02 503/200
2015/0027579 A1 * 1/2015 Campbell ..... F16L 3/223 138/104
2015/0251464 A1 * 9/2015 Kubota ..... G09F 3/0295 347/104
2016/0297217 A1 10/2016 Sasaki
2018/0015739 A1 * 1/2018 Sun ..... B41J 3/36
2018/0015742 A1 * 1/2018 Inoue ..... B41J 3/36
2018/0015748 A1 * 1/2018 Kato ..... B41J 17/32

FOREIGN PATENT DOCUMENTS

EP 2977218 A1 1/2016
EP 3075804 A1 10/2016
JP 2013111756 A 6/2013
JP 2017-064925 A 4/2017
WO 2010129131 A1 11/2010
WO 2017038585 A1 3/2017

OTHER PUBLICATIONS

Nov. 30, 2018—U.S. Non-Final Office Action—U.S. Appl. No. 15/939,851.
Oct. 17, 2018—(EP) Partial Search Report—App 18160624.5.
Mar. 29, 2018—U.S. Co-pending U.S. Appl. No. 15/939,851.
Mar. 29, 2018—U.S. Co-pending U.S. Appl. No. 15/939,917.
May 20, 2019—(US) Notice of Allowance—U.S. Appl. No. 15/939,851.

* cited by examiner

FIG.6A
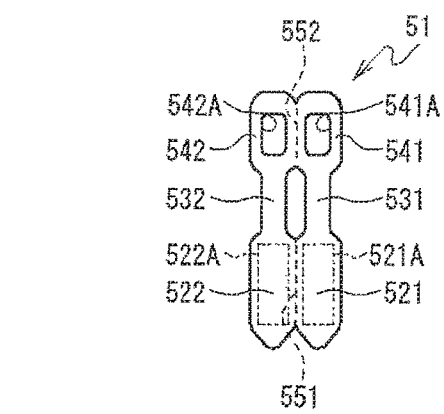
FIG.6B
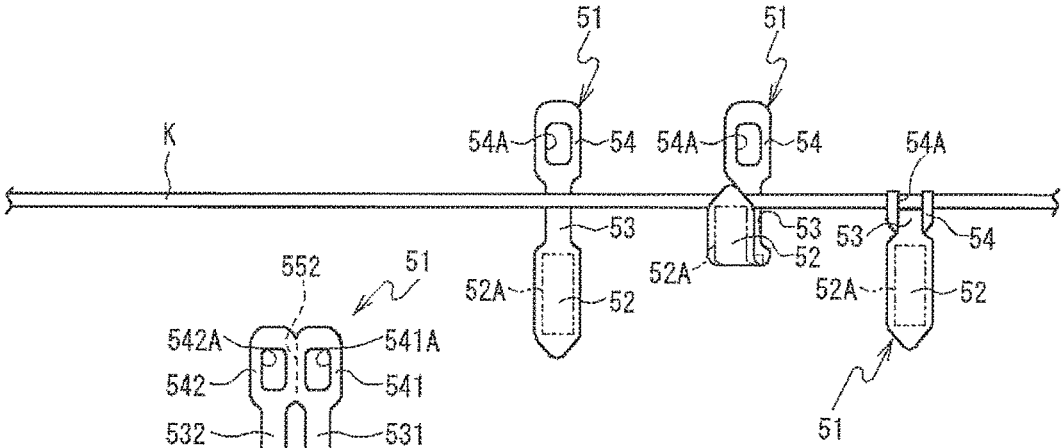
FIG.6C
FIG.6D
FIG.7
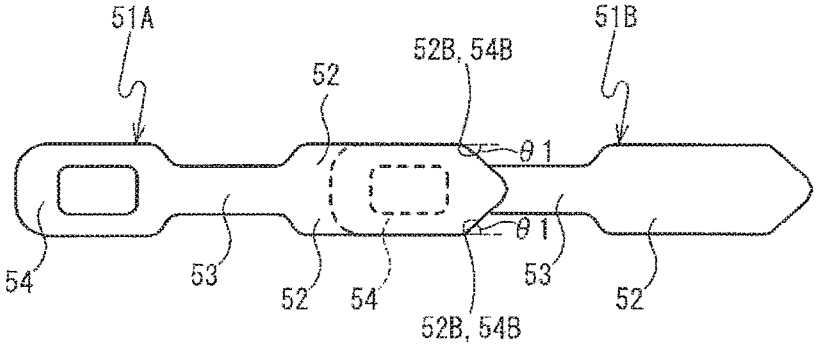

LABEL MEDIUM AND CASSETTE

CROSS REFERENCE TO RELATED APPLICATION

The present application claims priority from Japanese Patent Application No. 2017-129487, which was filed on Jun. 30, 2017, the disclosure of which is herein incorporated by reference in its entirety.

BACKGROUND

The following disclosure relates to a label medium and a cassette for creating a label to be wrapped and held on a wrapped member such as a cable.

There is known a label printed on a printed tape having an adhesive layer. The label has a label main portion and a wrapping portion. Information is printed on the label main portion based on print data. Mountain fold is performed for the label main portion along perforation, so that back surfaces of the label main portion are stuck to each other by the adhesive layer. The wrapping portion is folded back and wrapped on a wrapped member such as a cable. Back surfaces of the wrapping portion are thereby bonded to the wrapped member by the adhesive layer, and at the same time the back surfaces of the wrapping portion are bonded to each other by the adhesive layer.

SUMMARY

The above-described label is bonded to the wrapped member by the adhesive layer. This leads to difficulty in removing the label from the wrapped member and in changing a position at which the label is held on the wrapped member.

Accordingly, an aspect of the disclosure relates to a label medium and a cassette containing the label medium for creating a label easily changeable in position with respect to the wrapped member and easily removable from the wrapped member.

In one aspect of the disclosure, a label medium includes: a mount sheet; and a label stuck to the mount sheet and including (i) a first indicator portion and a second indicator portion each including a region on which information is printable, (ii) a first wrapping portion and a second wrapping portion to be wrapped on a wrapped member, (iii) a first through portion having at least a portion of a first hole or a first slit through which the first indicator portion and the second indicator portion are to be passed, and (iv) a second through portion having at least a portion of a second hole or a second slit through which the first indicator portion and the second indicator portion are to be passed. The first indicator portion, the first wrapping portion, and the first through portion are arranged in order of the first indicator portion, the first wrapping portion, and the first through portion in a first direction parallel with a surface of the mount sheet. The second indicator portion, the second wrapping portion, and the second through portion are arranged in order of the second indicator portion, the second wrapping portion, and the second through portion in one of the first direction and a second direction opposed to the first direction. The first indicator portion and the second indicator portion, the first wrapping portion and the second wrapping portion, or the first through portion and the second through portion are at least connected to each other via a line. At least a portion of the first indicator portion and at least a portion of the second indicator portion are symmetric with respect to an imaginary line extending along the line. At least a portion of the first wrapping portion and at least a portion of the second wrapping portion are symmetric with respect to the imaginary line. At least a portion of the first through portion and at least a portion of the second through portion are symmetric with respect to the imaginary line. At least a portion of the first hole or the first slit and at least a portion of the second hole or the second slit are symmetric with respect to the imaginary line.

In another aspect of the disclosure, a cassette contains a roll that is formed by winding a label medium around a spool. The label medium includes: a mount sheet; and a label stuck to the mount sheet and including (i) a first indicator portion and a second indicator portion each including a region on which information is printable, (ii) a first wrapping portion and a second wrapping portion to be wrapped on a wrapped member, (iii) a first through portion having at least a portion of a first hole or a first slit through which the first indicator portion and the second indicator portion are to be passed, and (iv) a second through portion having at least a portion of a second hole or a second slit through which the first indicator portion and the second indicator portion are to be passed. The first indicator portion, the first wrapping portion, and the first through portion are arranged in order of the first indicator portion, the first wrapping portion, and the first through portion in a first direction parallel with a surface of the mount sheet. The second indicator portion, the second wrapping portion, and the second through portion are arranged in order of the second indicator portion, the second wrapping portion, and the second through portion in one of the first direction and a second direction opposed to the first direction. The first indicator portion and the second indicator portion, the first wrapping portion and the second wrapping portion, or the first through portion and the second through portion are at least connected to each other via a line. At least a portion of the first indicator portion and at least a portion of the second indicator portion are symmetric with respect to an imaginary line extending along the line. At least a portion of the first wrapping portion and at least a portion of the second wrapping portion are symmetric with respect to the imaginary line. At least a portion of the first through portion and at least a portion of the second through portion are symmetric with respect to the imaginary line. At least a portion of the first hole or the first slit and at least a portion of the second hole or the second slit are symmetric with respect to the imaginary line. The first indicator portion, the first wrapping portion, and the first through portion are arranged in order of the first indicator portion, the first wrapping portion, and the first through portion in a direction directed from one of opposite ends of the label medium, which one is connected to the spool, toward the other of the opposite ends of the label medium. The second indicator portion, the second wrapping portion, and the second through portion are arranged in order of the second indicator portion, the second wrapping portion, and the second through portion in the direction directed from the one of the opposite ends of the label medium toward the other end of the opposite ends of the label medium.

BRIEF DESCRIPTION OF THE DRAWINGS

The objects, features, advantages, and technical and industrial significance of the present disclosure will be better understood by reading the following detailed description of the embodiments, when considered in connection with the accompanying drawings, in which:

FIGS. 6A through 6D are views indicating a method of attaching a label to a wrapped member;

FIG. 7 is a view for explaining a using manner in a state in which labels are connected to each other;

DETAILED DESCRIPTION OF THE EMBODIMENTS

Figure 1:
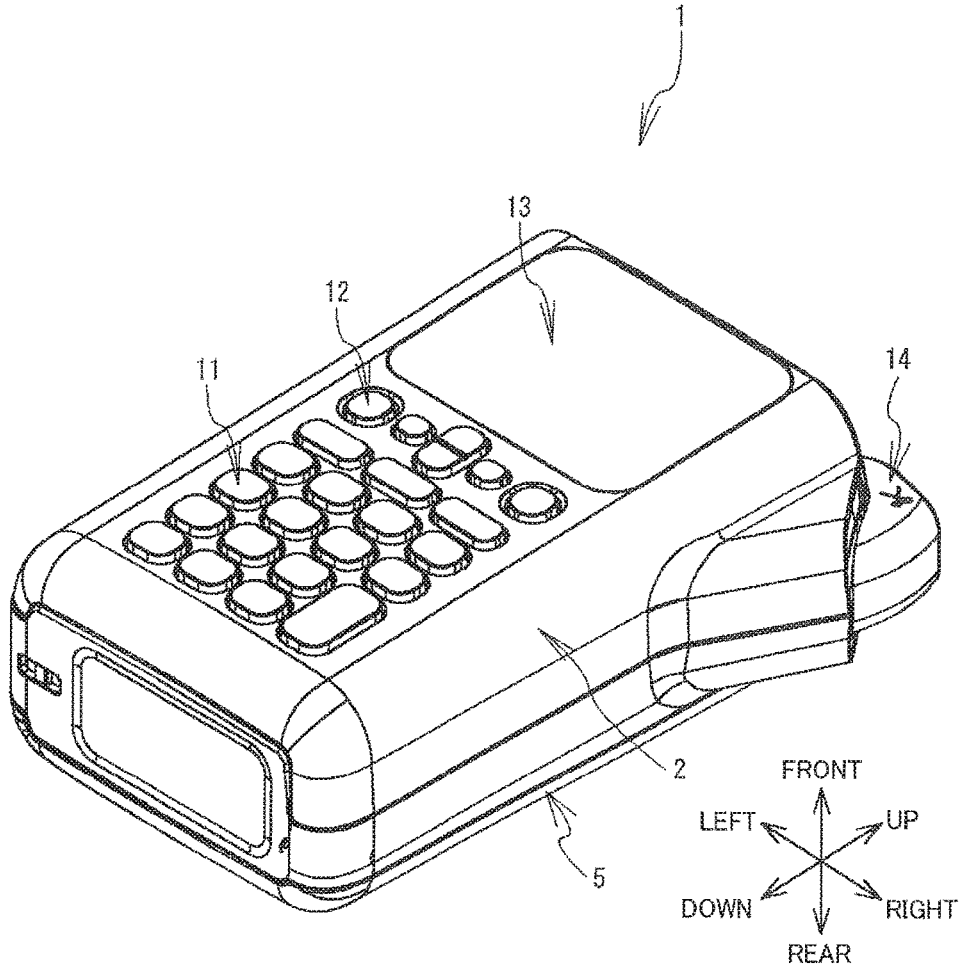
FIG. 1 is a perspective view of a printing apparatus viewed from a lower right rear side thereof.

Hereinafter, there will be described embodiments by reference to the drawings. The drawings are for explanation of technical features employable in the present disclosure. It is to be understood that the configuration illustrated in the drawings does not limit the present disclosure and is only one example.

Overall Configuration of Printing Apparatus

There will be described an overall configuration of a printing apparatus 1 with reference to FIGS. 1-3. The upper side, the lower side, the lower right side, the upper left side, the upper right side, and the lower left side in FIG. 1 are defined as a front side, a rear side, a right side, a left side, an upper side, and a lower side of the printing apparatus 1, respectively.

As illustrated in FIG. 1, the printing apparatus 1 has a substantially rectangular parallelepiped shape. The printing apparatus 1 includes a body housing 2 and a cover 5. The body housing 2 and the cover 5 are formed of resin. A keyboard 11 is provided on a lower portion of an upper surface of the body housing 2. The keyboard 11 is used for input of characters, for example. A function key group 12 is provided on an upper side of the keyboard 11. The function key group 12 is for turning a power source on and off and controlling print keys and the printing apparatus 1, for example. A liquid crystal display 13 is provided on an upper side of the function key group 12. The liquid crystal display 13 is configured to display characters and symbols input by a user, for example. The cover 5 is openably attached to a lower portion of the body housing 2.

Figure 2:
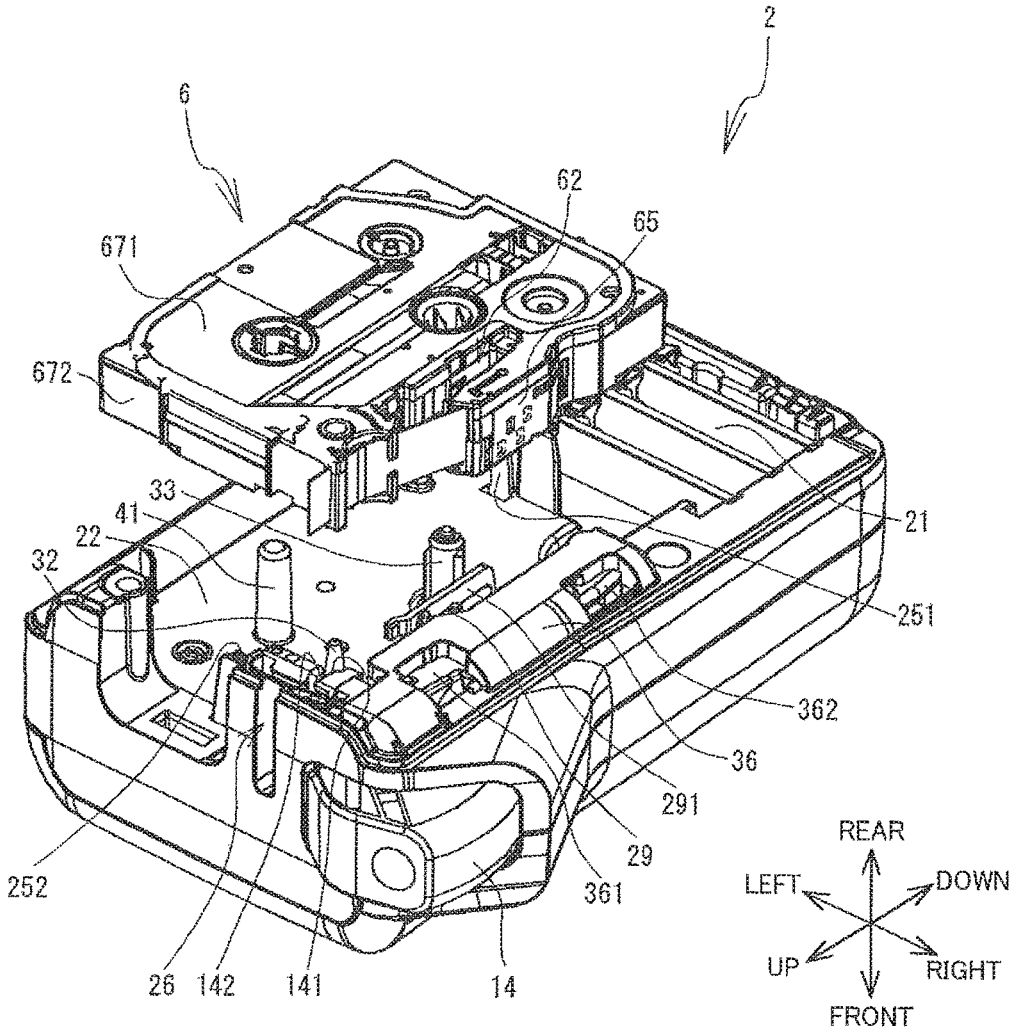
FIG. 2 is a perspective view of the printing apparatus, with a cover opened.
Figure 3:
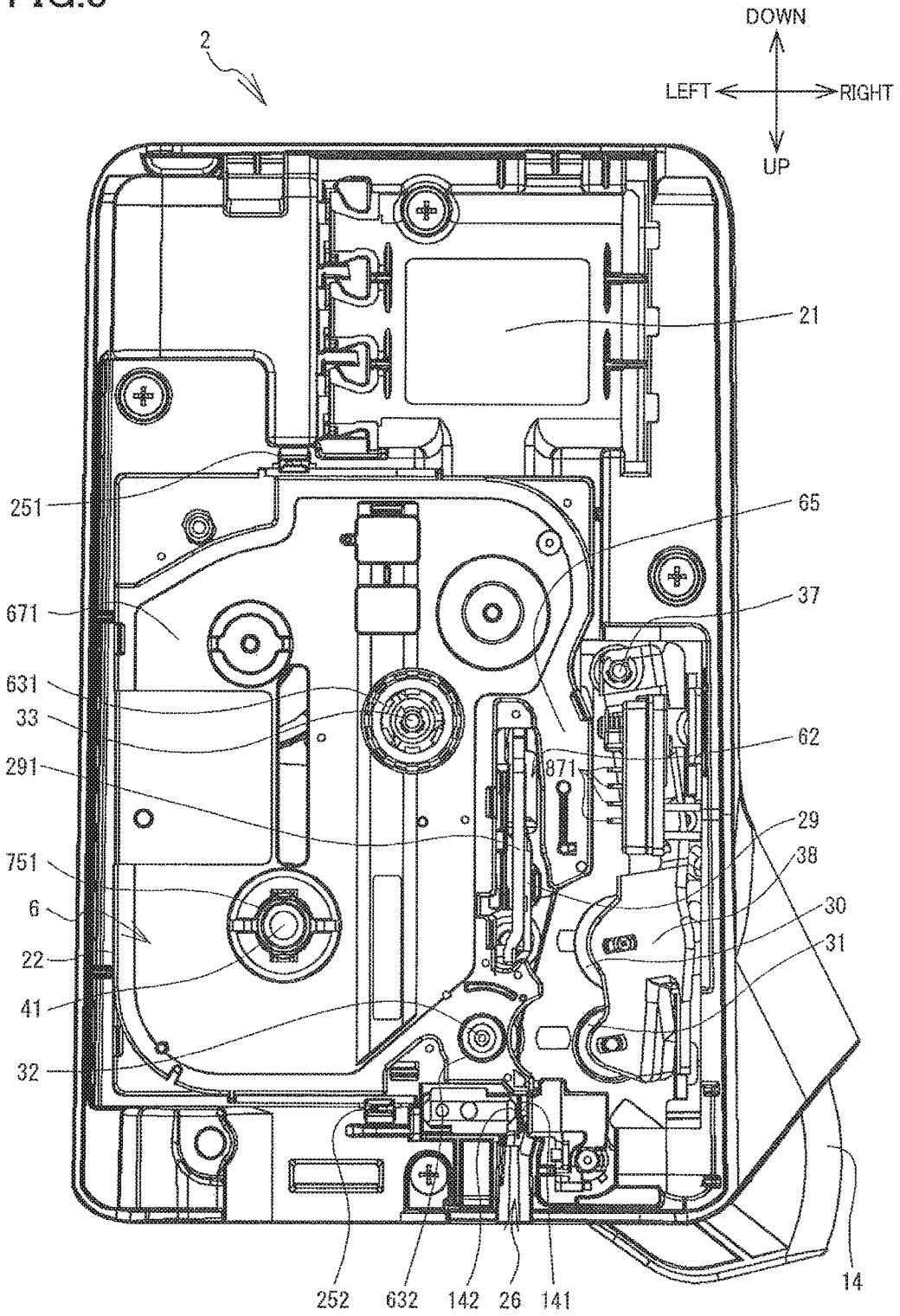
FIG. 3 is a plan view of a protector partly cut out.

As illustrated in FIGS. 2 and 3, a battery holder 21 is provided at a lower right corner portion of the body housing 2. Three batteries are installable in and removable from the battery holder 21. A cassette holder 22 is provided on an upper side of the battery holder 21 so as be contiguous to the battery holder 21. A tape cassette 6 is installable in and removable from the cassette holder 22 through its rear portion. A hook 251 protrudes rearward from a lower end portion of the cassette holder 22. A hook 252 protrudes rearward from an upper end portion of the cassette holder 22. The hooks 251, 252 are engageable with the tape cassette 6 installed on the cassette holder 22.

An upper portion of the body housing 2 has a label output opening 26. A cutting knob 14 is provided on a corner portion located to the right of the label output opening 26. A movable blade 141 is provided in the label output opening 26. When pushed inwardly, the cutting knob 14 moves the movable blade 141 toward a fixed blade 142 to cut the printed label medium 60 (see FIG. 4). The printed label medium 60 cut by the fixed blade 142 and the movable blade 141 is discharged from the label output opening 26.

As illustrated in FIG. 3, the cassette holder 22 is provided with a thermal head 29, a platen roller 30, a tape sub-roller 31, a tape-driving-roller shaft 32, and a ribbon take-up shaft 33, for example. The platen roller 30 is provided to the right of the thermal head 29. The tape sub-roller 31 is provided near an upper portion of the platen roller 30. The tape-driving-roller shaft 32 is provided to the left of the tape sub-roller 31. The ribbon take-up shaft 33 is provided at a substantially center of the cassette holder 22.

The thermal head 29 is provided on a surface of a head holder 291 which faces rightward. The head holder 291 is provided on the cassette holder 22 so as to be substantially orthogonal to a direction in which the label medium 60 is conveyed in a head inserted portion 62 of the tape cassette 6.

The ribbon take-up shaft 33 is rotatably fitted in a ribbon take-up spool 631 provided on the tape cassette 6. The tape-driving-roller shaft 32 is rotatably fitted in a tape conveying roller 632 provided on the tape cassette 6. The ribbon take-up shaft 33 and the tape-driving-roller shaft 32 are rotated such that the label medium 60 and an ink ribbon 613 (see FIG. 4) are conveyed at the same speed.

As illustrated in FIG. 2, a protector 36 is provided at a right end portion of the body housing 2 which is located on an upper side of substantially the center of the body housing 2 in the up and down direction. The protector 36 is open toward the left side. The protector 36 has two through holes, namely, a cam guide hole 361 and a cam guide hole 362. In front of the protector 36, a platen holder 38 illustrated in FIG. 3 is supported so as to be pivotable about a pivot shaft 37. The platen roller 30 and the tape sub-roller 31 are supported by the platen holder 38 so as to be rotatable in the counterclockwise direction in plan view. A spring, not illustrated, urges the platen holder 38 such that the platen holder 38 pivots rightward about the pivot shaft 37.

Overall Configuration of Tape Cassette 6

Figure 4:
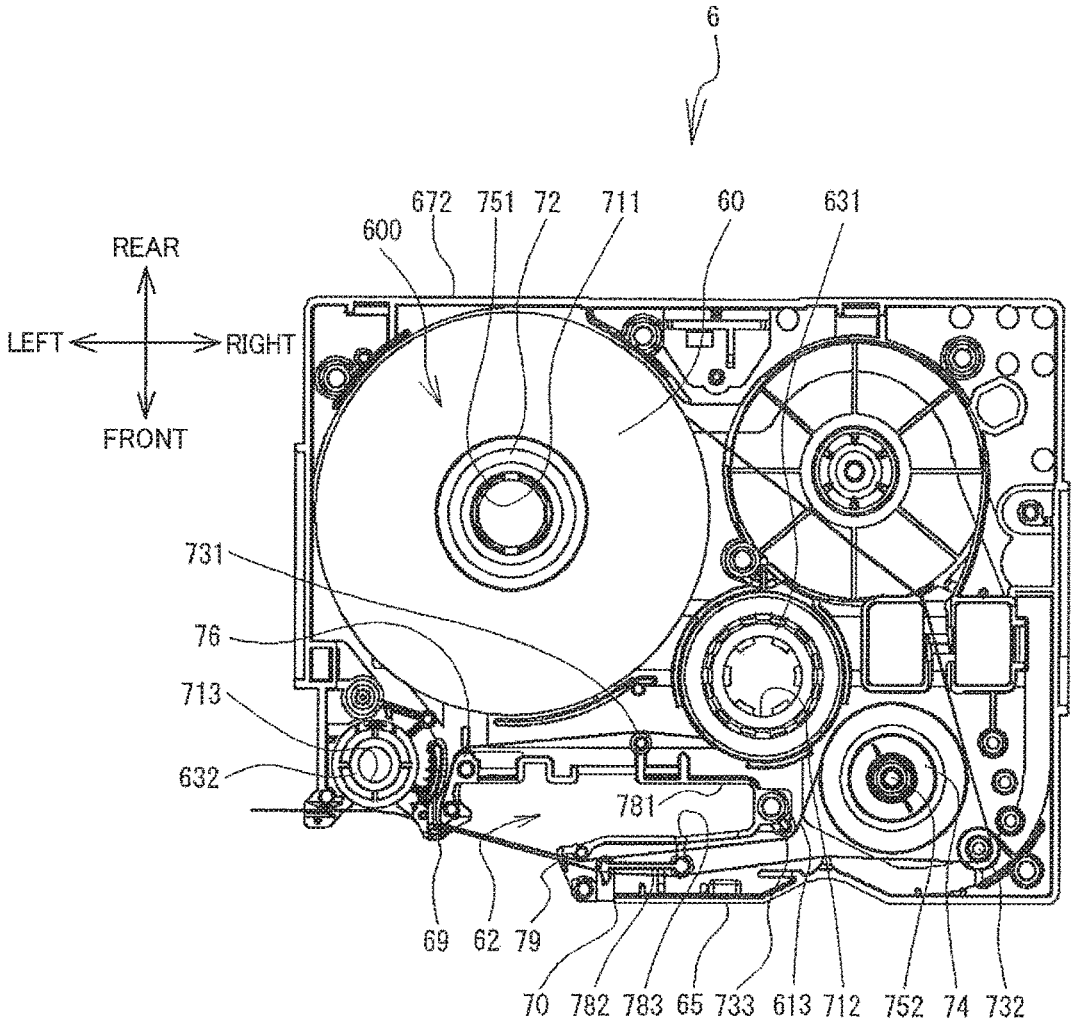
FIG. 4 is a plan view of a tape cassette, with an upper casing removed.

There will be next explained an overall configuration of the tape cassette 6. In the following explanation, the lower side, the upper side, the right side, and the left side in FIG. 4, and the front surface and the back surface of the sheet of FIG. 4 are defined as a front side, a rear side, a right side, a left side, an upper side, and a lower side of the tape cassette 6, respectively.

As illustrated in FIG. 2, the tape cassette 6 is shaped like a box having a substantially rectangular shape in plan view. The tape cassette 6 includes an upper casing 671 and a lower casing 672. As illustrated in FIG. 4, the tape cassette 6 has a support hole 711, a support hole 712, and a support hole 713. The support hole 711 supports a tape spool 72 such that the tape spool 72 is pivotable. The label medium 60 is rolled around the tape spool 72. The tape spool 72 holds a roll 600 formed by rolling the label medium 60. The support hole 712 supports the ribbon take-up spool 631. The ribbon take-up spool 631 takes up the ink ribbon 613 from a ribbon spool 74. The tape spool 72 and the ribbon spool 74 are rotatably fitted on a cassette boss 751 and a reel boss 752, respectively. The cassette boss 751 and the reel boss 752 are provided upright on a lower surface of the lower casing 672. The support hole 713 supports the tape conveying roller 632 such that the tape conveying roller 632 is rotatable. The tape conveying roller 632 and the tape sub-roller 31 (see FIG. 3) draw the label medium 60 from the roll 600 disposed around the tape spool 72.

An arm 65 protruding in an arm shape is provided on a front surface portion of the tape cassette 6. The head inserted portion 62 is formed by the arm 65 and a side wall 781 opposed to the arm 65 such that the head inserted portion 62 has a substantially U-shape in plan view. The head holder 291 (see FIG. 3) is inserted in the head inserted portion 62.

A pair of upper and lower guides 69 are provided near a front portion of the tape conveying roller 632. A ribbon separator 76 is provided near rear portions of the respective guides 69. A separation wall 782 shaped like a thin plate is provided at a central area between a front wall 70 of the arm 65 and a back wall 783 of the arm 65 which is nearer to the head inserted portion 62 than the front wall 70. An arm opening 79 is formed near a left end portion of the separation wall 782.

Print Procedure

As illustrated in FIGS. 2, 3, and 4, the ribbon take-up shaft 33 and the tape-driving-roller shaft 32 are respectively fitted in the ribbon take-up spool 631 and the tape conveying roller 632 provided on the tape cassette 6, and the head holder 291 is inserted in the head inserted portion 62. A positioning boss 41 provided upright on a bottom surface portion of the cassette holder 22 is fitted in the cassette boss 751. As a result, the tape cassette 6 is pressed in a state in which the tape cassette 6 is positioned, whereby the tape cassette 6 is installed on the cassette holder 22. After the tape cassette 6 is installed on the cassette holder 22, the cover 5 is closed. In the case where the cover 5 is closed, a roller-holder cam, not illustrated, provided on the cover 5 is fitted in the cam guide hole 361. The roller-holder cam presses the platen holder 38 leftward. The platen holder 38 pivots leftward against an urging force of the spring, not illustrated.

The label medium 60 is conveyed from the tape spool 72 via a guide pin 732 through an area between the separation wall 782 and the front wall 70 of the arm 65. The ink ribbon 613 is conveyed from the ribbon spool 74 via a guide pin 733 through an area between the separation wall 782 and the back wall 783 of the arm 65. The ink ribbon 613 and the label medium 60 are arranged one on another and conveyed from the arm opening 79 to the head inserted portion 62. The label medium 60 and the ink ribbon 613 are then pressed onto the thermal head 29 by the platen roller 30. Heat generated by the thermal head 29 heats the ink ribbon 613 from an upper side thereof. As a result, ink is transferred to the label medium 60 by heat, so that information such as characters is printed on the label medium 60.

The ink ribbon 613 is separated from the label medium 60 by the ribbon separator 76. The separated ink ribbon 613 is conveyed through a guide pin 731 and taken up by the ribbon take-up spool 631. The printed label medium 60 from which the ink ribbon 613 is separated by the ribbon separator 76 is conveyed to the tape conveying roller 632 in a state in which upward and downward movement of the printed label medium 60 is restricted by the guides 69. A printed first label medium 60A is then pressed by the tape sub-roller 31 onto the tape conveying roller 632 that is rotated by the tape-driving-roller shaft 32. The printed label medium 60 is discharged from the label output opening 26 by rotation of the tape conveying roller 632.

First Label Medium 60A According to First Embodiment

Figure 5A:
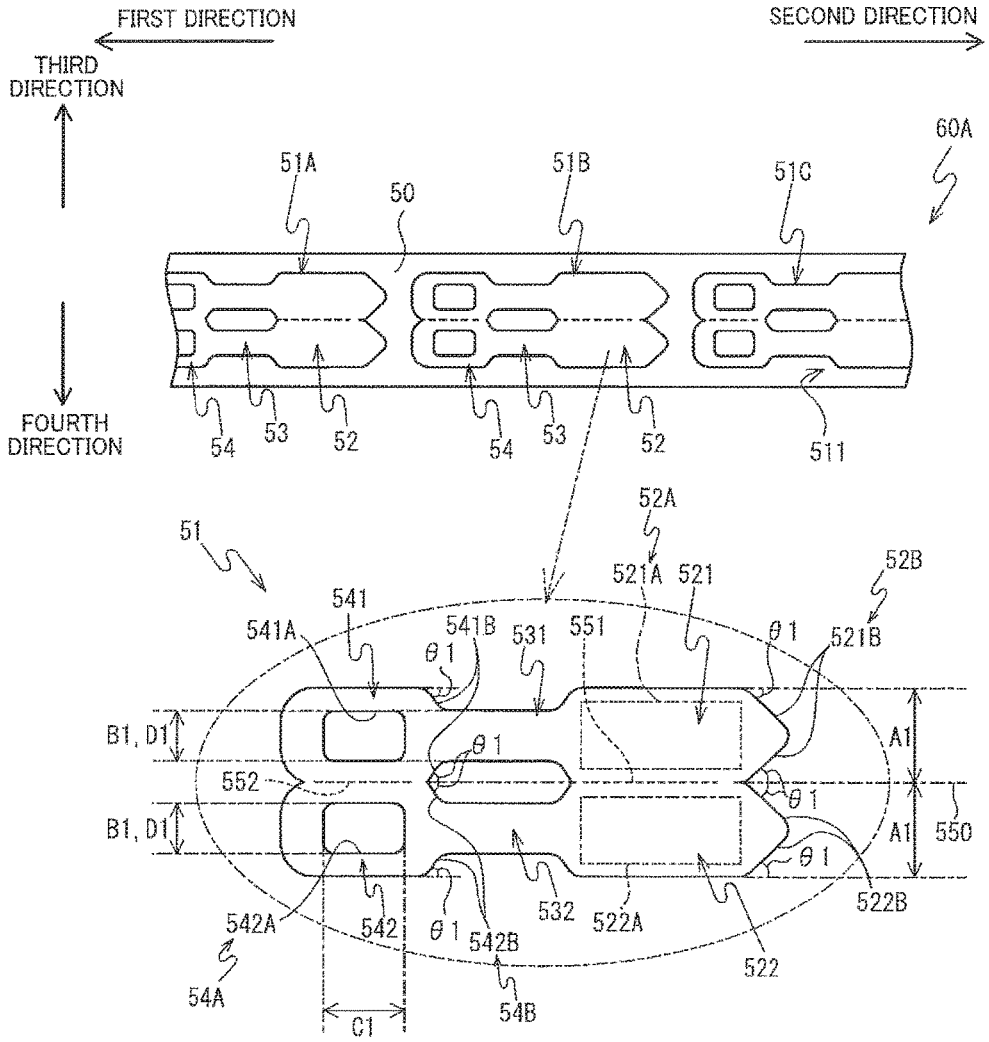
FIGS. 5A and 5B are views of a first label medium.
Figure 5B:
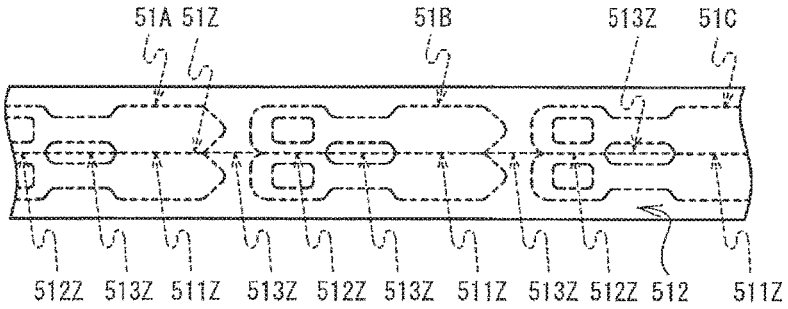

There will be next explained the first label medium 60A according to a first embodiment of the label medium 60 with reference to FIGS. 5A and 5B. The first label medium 60A includes an elongated substrate 511 (see FIG. 5A) and an elongated mount sheet 512 (see FIG. 5B). The substrate 511 and the mount sheet 512 have the same shape. The substrate 511 includes a frame portion 50 and labels 51A, 51B, 51C, and so on (which may be collectively referred to as "label 51"). The labels 51A, 51B, 51C, and so on are arranged in an elongated (longitudinal) direction of the first label medium 60A. The ink is transferred from the ink ribbon 613 to the label 51. The mount sheet 512 is release paper which is separated in use of the label 51. The substrate 511 (the label 51 and the frame portion 50) and the mount sheet 512 are stacked on each other. Adhesive is applied to facing surfaces of the substrate 511 and the mount sheet 512. The adhesive is disposed between the substrate 511 and the mount sheet 512. The label 51 and the frame portion 50 are stuck to the mount sheet 512 by the adhesive. The right and left direction in FIGS. 5A and 5B is directed in parallel with the surfaces of the substrate 511 and the mount sheet 512 of the first label medium 60A and coincides with the elongated direction of the first label medium 60A. A right end portion of the first label medium 60A in FIG. 5A is connected to the tape spool 72. The first label medium 60A is conveyed through an area near the thermal head 29, then printed, and discharged through the label output opening 26 in order from a left end portion of the first label medium 60A in FIG. 5A.

One of opposite directions as the elongated direction of the first label medium 60A is a direction directed toward an end portion of the first label medium 60A which is opposite to its end portion connected to the tape spool 72. This direction may be hereinafter referred to as "first direction" coinciding with the left direction in FIGS. 5A and 5B. The other of the opposite directions as the elongated direction of the first label medium 60A is a direction directed toward the end portion of the first label medium 60A which is connected to the tape spool 72. This direction may be hereinafter referred to as "second direction" coinciding with the right direction in FIGS. 5A and 5B. The first direction and the second direction are parallel with the elongated direction of the first label medium 60A. A direction orthogonal to the elongated direction of the first label medium 60A is hereinafter referred to as "orthogonal direction". One of opposite directions as the orthogonal direction (the up direction in FIGS. 5A and 5B) may be hereinafter referred to as "third direction". The other of the opposite directions as the orthogonal direction (the down direction in FIGS. 5A and 5B) may be hereinafter referred to as "fourth direction". The third direction and the fourth direction are parallel with the orthogonal direction.

As illustrated in FIG. 5A, the label 51 includes a first indicator portion 521, a second indicator portion 522, a first wrapping portion 531, a second wrapping portion 532, a first through portion 541, and a second through portion 542. The first indicator portion 521 and the second indicator portion 522 have the same shape and the same size. The first wrapping portion 531 and the second wrapping portion 532 have the same shape and the same size. The first through portion 541 and the second through portion 542 have the same shape and the same size. The first indicator portion 521 and the second indicator portion 522 may be hereinafter collectively referred to as "indicator portion 52". The first wrapping portion 531 and the second wrapping portion 532 may be hereinafter collectively referred to as "wrapping portion 53". The first through portion 541 and the second through portion 542 may be hereinafter collectively referred to as "through portion 54".

The indicator portion 52 has a substantially rectangular shape. The longitudinal direction of the indicator portion 52 coincides with the elongated direction of the first label medium 60A. The first indicator portion 521 and the second indicator portion 522 are arranged in the orthogonal direction. The first indicator portion 521 is disposed on a third-direction-side of the second indicator portion 522. A fourth-direction-side end portion of the first indicator portion 521 and a third-direction-side end portion of the second indicator portion 522 are connected to each other, with a first line 551 located therebetween. The first line 551 extends in a direction parallel with the elongated direction of the first label medium 60A (the first direction and the second direction). That is, the first line 551 is a line which is a portion of the substrate 511 and in which perforation that will be described below is formed, and the first line 551 is located between the fourth-direction-side end portion of the first indicator portion 521 and the third-direction-side end portion of the second indicator portion 522 and connects the first indicator portion 521 and the second indicator portion 522 to each other. The first line 551 has an elongated shape, and the elongated direction of the first line 551 is parallel with the elongated direction of the first label medium 60A and with the first direction. The first line 551 includes the perforation formed in the substrate 511, and the elongated direction of the first line 551 and the direction in which the perforation extends are parallel with each other. The perforation formed at the first line 551 is located between the fourth-direction-side end portion of the first indicator portion 521 and the third-direction-side end portion of the second indicator portion 522, and the direction in which the perforation extends is parallel with the elongated direction of the first label medium 60A and with the first direction. An imaginary line extending through the first line 551 in the elongated direction of the first label medium 60A may be hereinafter referred to as "imaginary line 550". That is, the imaginary line 550 is an imaginary line extending through the perforation formed at the first line 551. The imaginary line 550 is an imaginary line which is located equidistant from the first indicator portion 521 and the second indicator portion 522 and which extends in the direction parallel with the elongated direction of the first label medium 60A. Accordingly, the first indicator portion 521 and the second indicator portion 522 are symmetric with respect to the imaginary line 550. The length of the indicator portion 52 in the orthogonal direction (the third direction and the fourth direction) is a length A1. It is noted that the first line 551 also serves as a boundary line between the fourth-direction-side end portion of the first indicator portion 521 and the third-direction-side end portion of the second indicator portion 522.

The indicator portion 52 has a region 52A on which information is printed with the ink transferred from the ink ribbon 613. The region 52A of the first indicator portion 521 will be referred to as "region 521A", and the region 52A of the second indicator portion 522 will be referred to as "region 522A".

A second-direction-side end portion of the indicator portion 52 has indicator tapered portions 52B at opposite end portions of the second-direction-side end portion in the orthogonal direction. Each of the indicator tapered portions 52B is inclined with respect to the orthogonal direction. Due to the indicator tapered portions 52B, the length of the second-direction-side end portion of the indicator portion 52 in the orthogonal direction decreases so as to be less at a second-direction-side portion (a right portion in FIG. 5A) of the second-direction-side end portion than at a first-direction-side portion (a left portion in FIG. 5A) of the second-direction-side end portion. The indicator tapered portion 52B of the first indicator portion 521 will be referred to as "first indicator tapered portion 521B", and the indicator tapered portion 52B of the second indicator portion 522 will be referred to as "second indicator tapered portion 522B". The first indicator tapered portion 521B and the second indicator tapered portion 522B are symmetric with respect to the imaginary line 550. The angle of inclination of the indicator tapered portion 52B with respect to the second direction is an angle θ1.

The wrapping portion 53 has a substantially rectangular shape. The longitudinal direction of the wrapping portion 53 coincides with the elongated direction. The length of the wrapping portion 53 in the orthogonal direction is less than the length A1 of the indicator portion 52 in the orthogonal direction. The wrapping portion 53 extends in the first direction from a central portion of a first-direction-side end portion of the indicator portion 52 in the orthogonal direction. The first wrapping portion 531 and the second wrapping portion 532 are arranged in the orthogonal direction with a space therebetween. The first wrapping portion 531 is disposed on a third-direction-side of the second wrapping portion 532. The first wrapping portion 531 and the second wrapping portion 532 are symmetric with respect to the imaginary line 550. The wrapping portion 53 is wrapped around the wrapped member, whereby the label 51 is attached to the wrapped member. The length of the wrapping portion 53 in the orthogonal direction is a length B1.

The through portion 54 has a substantially rectangular shape. The longitudinal direction of the through portion 54 coincides with the elongated direction of the first label medium 60A. The length of the through portion 54 in the orthogonal direction is equal to the length A1 of the indicator portion 52 in the orthogonal direction and greater than the length B1 of the wrapping portion 53 in the orthogonal direction. The through portion 54 extends in the first direction from a first-direction-side end portion of the wrapping portion 53. The first through portion 541 and the second through portion 542 are arranged in the orthogonal direction. The first through portion 541 is disposed on a third-direction-side of the second through portion 542. A fourth-direction-side end portion of the first through portion 541 and a third-direction-side end portion of the second through portion 542 are connected to each other, with a second line 552 located therebetween. The second line 552 extends along the imaginary line 550 in the direction parallel with the elongated direction of the first label medium 60A. That is, the second line 552 is a line which is a portion of the substrate 511 and in which perforation that will be described below is formed, and the second line 552 is located between the first through portion 541 and the second through portion 542 and connects the first through portion 541 and the second through portion 542 to each other. The second line 552 has an elongated shape, and the elongated direction of the second line is parallel with the elongated direction of the first label medium 60A and with the first direction. The first line 551 and the second line 552 extend along the imaginary line 550 on the same straight line. The second line 552 includes the perforation formed in the substrate 511, and the elongated direction of the second line 552 and the direction in which the perforation extends are parallel with each other. The perforation formed in the second line 552 is located between the first through portion 541 and the second through portion 542, and the direction in which the perforation extends is parallel with the elongated direction of the first label medium 60A and with the first direction. The first through portion 541 and the second through portion 542 are symmetric with respect to the imaginary line 550. That is, the imaginary line 550 is an imaginary line which is located equidistant from the first through portion 541 and the second through portion 542 and which extends in the direction parallel with the elongated direction of the first label medium 60A.

The first through portion 541 has a first hole 541A, and the second through portion 542 has a second hole 542A. Each of the first hole 541A and the second hole 542A has a substantially rectangular shape. The first hole 541A and the second hole 542A have the same shape and the same size. The first hole 541A is disposed on a first-direction side of the first wrapping portion 531. Thus, the first hole 541A and the first wrapping portion 531 overlap each other in the first direction. That is, when viewed in the first direction, the first hole 541A and the first wrapping portion 531 overlap each other. The second hole 542A is disposed on a first-direction side of the second wrapping portion 532. Thus, the second hole 542A and the second wrapping portion 532 overlap each other in the first direction. That is, when viewed in the first direction, the second hole 542A and the second wrapping portion 532 overlap each other. The first hole 541A and the second hole 542A are symmetric with respect to the imaginary line 550.

The first hole 541A and the second hole 542A may be collectively referred to as "hole 54A". The indicator portion 52 and the wrapping portion 53 are inserted through the hole 54A of the through portion 54, whereby the label 51 is attached to the wrapped member. The length of the elongated direction of the hole 54A is a length C1. The length of the hole 54A in the orthogonal direction is a length D1. The length C1 of the elongated direction of the hole 54A is equal to the length A1 of the indicator portion 52 in the orthogonal direction. The length D1 of the hole 54A in the orthogonal direction is equal to the length B1 of the wrapping portion 53 in the orthogonal direction.

The second-direction-side end portion of the through portion 54 has through-portion tapered portions 54B respectively located on a third-direction side and a fourth-direction side of a portion of the through portion 54 which is connected to the wrapping portion 53. Each of the through-portion tapered portions 54B is inclined with respect to the orthogonal direction. Due to the through-portion tapered portions 54B, the length of the second-direction-side end portion of the through portion 54 in the orthogonal direction decreases so as to be less at a second-direction-side portion (a right portion in FIG. 5A) of the second-direction-side end portion than at a first-direction-side portion (a left portion in FIG. 5A) of the second-direction-side end portion. The through-portion tapered portion 54B of the first through portion 541 will be referred to as "first through-portion tapered portion 541B", and the through-portion tapered portion 54B of the second through portion 542 will be referred to as "second through-portion tapered portion 542B". The first through-portion tapered portion 541B and the second through-portion tapered portion 542B are symmetric with respect to the imaginary line 550. The angle of inclination of each of the through-portion tapered portions 54B with respect to the second direction is the angle θ1 that is equal to the angle of inclination of each of the indicator tapered portions 52B with respect to the second direction.

The first indicator portion 521, the first wrapping portion 531, and the first through portion 541 are arranged in this order in the first direction. That is, the first indicator portion 521, the first wrapping portion 531, and the first through portion 541 are arranged in this order in the direction directed toward the end portion of the first label medium 60A which is opposite to its end portion connected to the tape spool 72. The first indicator portion 521, the first wrapping portion 531, and the first through portion 541 overlap one another in the first direction at their respective regions including their respective centers in the orthogonal direction. That is, when viewed in the first direction, the first indicator portion 521, the first wrapping portion 531, and the first through portion 541 overlap one another. The second indicator portion 522, the second wrapping portion 532, and the second through portion 542 are arranged in this order in the first direction. That is, the second indicator portion 522, the second wrapping portion 532, and the second through portion 542 are arranged in this order in the direction directed toward the end portion of the first label medium 60A which is opposite to its end portion connected to the tape spool 72. The second indicator portion 522, the second wrapping portion 532, and the second through portion 542 overlap one another in the first direction at their respective regions including their respective centers in the orthogonal direction. That is, when viewed in the first direction, the second indicator portion 522, the second wrapping portion 532, and the second through portion 542 overlap one another.

The frame portion 50 is the entire area of the substrate 511 except the labels 51. Slits are formed in the substrate 511 along boundaries between the frame portion 50 and each label 51. The user may detach the substrate 511 along the slits to peel off only the label 51 from the mount sheet 512. The frame portion 50 remains stuck to the mount sheet 512 in this operation.

As illustrated in FIG. 5B, the mount sheet 512 has perforation 51Z extending straight in the elongated direction. The perforation 51Z extends through positions on the mount sheet 512 which are respectively opposed to the first lines 551 and the second lines 552 of the labels 51A, 51B, 51C. That is, the perforation 51Z is formed in the mount sheet 512 so as to be opposed to the imaginary line 550. The perforation 51Z includes: perforations 511Z opposed to the respective first lines 551; perforations 512Z opposed to the respective second line 552; and perforations 513Z each located between corresponding adjacent two of the perforations 511Z, 512Z.

There will be next explained a method of attaching the label 51 to a wrapped member K in the form of a cable with reference to FIGS. 5A-6D. The printing apparatus 1 prints information on the region 52A of the indicator portion 52 of the label 51 illustrated in FIG. 5A. FIGS. 5A-6D omit illustration of the printed information. The user bends the first label medium 60A along the perforation 51Z formed in the mount sheet 512 and unbends the first label medium 60A to its original shape. This operation creates a bending line on the first line 551 and the second line 552 on the substrate 511. The bending line makes it easy to bend the first label medium.

As illustrated in FIG. 6A, the user peels off the label 51 from the mount sheet 512 of the first label medium 60A. As illustrated in FIG. 6B, the user bends the label 51 along the first line 551 and the second line 552 and sticks surfaces of portions of the label 51 which are coated with the adhesive. Here, the first indicator portion 521 and the second indicator portion 522 are symmetric with respect to the imaginary line 550 (see FIG. 5A) extending through the first line 551 and the second line 552. Likewise, the first wrapping portion 531 and the second wrapping portion 532 are symmetric with respect to the imaginary line 550, and the first through portion 541 and the second through portion 542 are symmetric with respect to the imaginary line 550. Accordingly, when the label 51 is bent along the first line 551 and the second line 552, the first indicator portion 521 and the second indicator portion 522 are stuck to each other without misalignment. Likewise, the first wrapping portion 531 and the second wrapping portion 532 are stuck to each other without misalignment. The first through portion 541 and the second through portion 542 are stuck to each other without misalignment. Thus, the surface of the label 51 which is coated with the adhesive is not exposed. Also, the first hole 541A and the second hole 542A are symmetric with respect to the imaginary line 550. Thus, the first hole 541A and the second hole 542A are aligned to each other.

The user then places the wrapping portion 53 on the wrapped member K. As illustrated in FIG. 6C, the user bends the wrapping portion 53 and passes the indicator portion 52 and the wrapping portion 53 through the hole 54A of the through portion 54. As a result, the wrapping portion 53 is wrapped around the wrapped member K. As illustrated in FIG. 6D, the user then pulls the indicator portion 52 and the wrapping portion 53 to tighten the wrapping portion 53 on the wrapped member K. As a result, the attachment of the label 51 to the wrapped member K is complete. The label 51 is held on the wrapped member K in the state in which the wrapping portion 53 is wrapped around the wrapped member K.

It is noted that the user may loosen the wrapping portion 53 tightened on the wrapped member K to change a position at which the label 51 is held on the wrapped member K. The user may pull out the indicator portion 52 and the wrapping portion 53 from the hole 54A of the through portion 54 to remove the label 51 from the wrapped member K.

Effects in First Embodiment

In the first label medium 60A, the first indicator portion 521 and the second indicator portion 522 of the label 51 are symmetric with respect to the imaginary line 550 extending through the first line 551 and the second line 552. Likewise, the first wrapping portion 531 and the second wrapping portion 532 are symmetric with respect to the imaginary line 550, the first through portion 541 and the second through portion 542 are symmetric with respect to the imaginary line 550, and the first hole 541A and the second hole 542A are symmetric with respect to the imaginary line 550. Thus, in the case where the label 51 is peeled off from the mount sheet 512, and the label 51 is bent along the first line 551 and the second line 552, the first indicator portion 521 and the second indicator portion 522 are placed one on another, the first wrapping portion 531 and the second wrapping portion 532 are placed one on another, and the first through portion 541 and the second through portion 542 are placed one on another. Likewise, the first hole 541A and the second hole 542A are aligned to each other. The user passes the indicator portion 52 through the hole 54A of the through portion 54 in this state and wraps the wrapping portion 53 on the wrapped member K in the form of a cable. As a result, the label 51 is held on the wrapped member K. In this case, the label 51 is not bonded to the wrapped member K with the adhesive, making it easy to move the label 51 on the wrapped member K and to remove the label 51 from the wrapped member K.

In the first label medium 60A, the first line 551 is provided at the boundary portion between the first indicator portion 521 and the second indicator portion 522 arranged in the orthogonal direction, and the second line 552 is provided at the boundary portion between the first through portion 541 and the second through portion 542 arranged in the orthogonal direction. The first indicator portion 521, the first wrapping portion 531, and the first through portion 541 are arranged in this order in the first direction. The second indicator portion 522, the second wrapping portion 532, and the second through portion 542 are arranged in this order in the first direction. The first line 551 and the second line 552 extend parallel with the first direction in which the indicator portion 52, the wrapping portion 53, and the through portion 54 are arranged. In this case, the first indicator portion 521 and the second indicator portion 522 are located near the first line 551, the first wrapping portion 531 and the second wrapping portion 532 are located near the imaginary line 550, and the first through portion 541 and the second through portion 542 are located near the second line 552. Thus, when bending the label 51 along the first line 551 and the second line 552, the user can easily bend the indicator portion 52, the wrapping portion 53, and the through portion 54 without misalignment.

The first indicator portion 521 and the second indicator portion 522 are connected to each other at the first line 551. The first through portion 541 and the second through portion 542 are connected to each other at the second line 552. Here, the first line 551 and the second line 552 extend along the imaginary line 550 on the same straight line. In this case, the user can easily bend the label 51 along the first line 551 and the second line 552. Also, the label 51 is bent at its two portions, e.g., the first line 551 and the second line 552. This configuration reduces misalignment between the first indicator portion 521 and the second indicator portion 522 and between the first through portion 541 and the second through portion 542.

The perforations 511Z and the perforations 512Z are formed in the mount sheet 512 so as to be opposed to the first line 551 and the second line 552, respectively. In this case, before peeling off the label 51 from the mount sheet 512, the user can bend the first label medium 60A along the perforations 511Z, 512Z to create the bending line on the first line 551 and the second line 552. Thus, after peeling off the label 51 from the mount sheet 512, the user can bend the label 51 along the bending line to accurately bend the label 51 along the first line 551 and the second line 552. This configuration reduces misalignment between the indicator portions 52, between the wrapping portions 53, and between the through portions 54 when the label 51 is bent. The perforation 513Z is formed in the mount sheet 512 between the adjacent perforations 511Z, 512Z. In this case, before peeling off the label 51 from the mount sheet 512, the user can easily bend the first label medium 60A along the perforations 511Z, 512Z, 513Z (the perforation 51Z).

The first indicator portion 521, the first wrapping portion 531, and the first through portion 541 overlap one another in the first direction at their respective regions including their respective centers in the orthogonal direction. The second indicator portion 522, the second wrapping portion 532, and the second through portion 542 overlap one another in the first direction at their respective regions including their respective centers in the orthogonal direction. That is, when viewed in the first direction, the first indicator portion 521, the first wrapping portion 531, and the first through portion 541 overlap one another at their respective regions including their respective centers in the orthogonal direction. This configuration of the first label medium 60A reduces the length of the label 51 in the orthogonal direction orthogonal to the first direction, resulting in reduction in required width of the first label medium 60A.

The length C1 of the hole 54A of the through portion 54 in the elongated direction is equal to the length A1 of the indicator portion 52 in the orthogonal direction. This configuration enables the user to pass the indicator portion 52 through the hole 54A in a state in which the indicator portion 52 is stretched in the process in which the user attaches the label 51 to the wrapped member K. Accordingly, the user can easily pass the indicator portion 52 through the hole 54A, whereby the user can easily attach the label 51 to the wrapped member K. In the case where the strength of the through portion 54 is taken into consideration, the size of the hole 54A is preferably small. Since the length C1 of the hole 54A of the through portion 54 is equal to the length A1 of the indicator portion 52 in the present embodiment, it is possible to pass the indicator portion 52 through the hole 54A in the state in which the indicator portion 52 is stretched and to reduce the size of the hole 54A. Accordingly, the strength of the through portion 54 is kept in the first label medium 60A.

The length D1 of the hole 54A of the through portion 54 in the orthogonal direction is equal to the length B1 of the wrapping portion 53 in the orthogonal direction. This configuration enables the user to pass the wrapping portion 53 through the hole 54A in a state in which the wrapping portion 53 is stretched in the process in which the user attaches the label 51 to the wrapped member K. Accordingly, the user can easily pass the wrapping portion 53 through the hole 54A, whereby the user can easily attach the label 51 to the wrapped member K. It is also possible to reduce bending of the wrapping portion 53 in the state in which the label 51 is held on the wrapped member K. Thus, the user can firmly hold the label 51 on the wrapped member K. In the case where the strength of the through portion 54 is taken into consideration, the size of the hole 54A is preferably small. Since the length C1 of the hole 54A of the through portion 54 is equal to the length B1 of the wrapping portion 53 in the present embodiment, it is possible to attach the wrapping portion 53 to the wrapped member K in the state in which the wrapping portion 53 is stretched and to reduce the size of the hole 54A. Accordingly, the strength of the through portion 54 is kept in the first label medium 60A.

The length B1 of the wrapping portion 53 in the orthogonal direction is less than the length A1 of each of the indicator portion 52 and the through portion 54 in the orthogonal direction. With this configuration, the length of the indicator portion 52 in the orthogonal direction is relatively large, resulting in large area of the region 52A on which the information is printable by the printing apparatus 1. Also, the strength of the through portion 54 is easily reduced by formation of the hole 54A. In the present embodiment, however, the length of the through portion 54 in the orthogonal direction is relatively large in the label 51, whereby the strength of the through portion 54 is not reduced.

The end portion of the indicator portion 52 which is not connected to the wrapping portion 53 and which is located on a second-direction side of the indicator portion 52 has the indicator tapered portions 52B. Thus, the length of the indicator portion 52 in the orthogonal direction decreases toward the second-direction side at the indicator tapered portions 52B. With this configuration, when the user passes the indicator portion 52 through the hole 54A of the through portion 54 in the process in which the user attaches the label 51 to the wrapped member K, there is a less possibility that a distal end of the indicator portion 52 is caught by the hole 54A. Also, the first indicator tapered portion 521B of the first indicator portion 521 and the second indicator tapered portion 522B of the second indicator portion 522 are symmetric with respect to the imaginary line 550. Thus, in the case where the label 51 is bent along the first line 551, it is possible to prevent the adhesive surfaces of the indicator tapered portions 52B from being exposed due to misalignment between the indicator tapered portions 52B stuck to each other.

In the case where the user attaches the label 51 to the wrapped member K having a large diameter, as illustrated in FIG. 7, the user in some case sticks the indicator portion 52 of the label 51A to the through portion 54 of the label 51B to extend the length of the label 51 in the elongated direction. In this case, the user needs to stick the indicator portion 52 of the label 51A and the through portion 54 of the label 51B to each other without misalignment in order to align the labels 51A, 51B in the orthogonal direction. In the present embodiment, the end portion of the indicator portion 52 which is not connected to the wrapping portion 53 and which is located on a second-direction side of the indicator portion 52 has the indicator tapered portions 52B, and the end portion of the through portion 54 which is connected to the wrapping portion 53 and which is located on a second-direction side of the through portion 54 has the through-portion tapered portions 54B. The angle θ1 of inclination of each of the indicator tapered portions 52B with respect to the second direction is equal to the angle θ1 of inclination of each of the through-portion tapered portions 54B with respect to the second direction. Accordingly, the user sticks the indicator tapered portion 52B of the indicator portion 52 of the label 51A to the through-portion tapered portion 54B of the through portion 54 of the label 51B with alignment between the indicator tapered portion 52B and the through-portion tapered portion 54B to stick the labels 51A, 51B to each other with alignment therebetween in the orthogonal direction.

The adhesive is applied between the mount sheet 512 and the substrate 511 including the label 51 and the frame portion 50. With this configuration, the user peels off the label 51 from the mount sheet 512 and bends the label 51 along the first line 551 and the second line 552, whereby the first indicator portion 521 and the second indicator portion 522 are stuck to each other with the adhesive, the first wrapping portion 531 and the second wrapping portion 532 are stuck to each other with the adhesive, and the first through portion 541 and the second through portion 542 are stuck to each other with the adhesive.

Each of the substrate 511 and the mount sheet 512 has an elongated shape. The labels 51A, 51B, 51C, and so on are arranged on the mount sheet 512 in the elongated direction. In the label 51, the indicator portion 52, the wrapping portion 53, and the through portion 54 are arranged in the first direction parallel with the elongated direction. With this configuration, the labels 51A, 51B, 51C, and so on are effectively arranged on the mount sheet 512 when compared with a case where the labels 51A, 51B, 51C, and so on are arranged in the orthogonal direction.

Each of the first line 551 and the second line 552 is the perforation formed in the substrate 511. This configuration enables the user to easily bend the label 51 along the first line 551 and the second line 552.

The substrate 511 and the mount sheet 512 have the same shape. The substrate 511 includes the label 51 and the frame portion 50 that is the entire area of the substrate 511 except the label 51. The slits are formed in the substrate 511 at the boundary portions between the label 51 and the frame portion 50. With this configuration, the user can peel off only the label 51 from the mount sheet 512 by detaching the substrate 511 along the slits.

In the label 51, the first indicator portion 521 and the second indicator portion 522 have the same shape and the same size. The first wrapping portion 531 and the second wrapping portion 532 have the same shape and the same size. The first through portion 541 and the second through portion 542 have the same shape and the same size. Accordingly, when the label 51 is bent by the user along the first line 551 and the second line 552, the first indicator portion 521 and the second indicator portion 522 are arranged one on another without misalignment, the first wrapping portion 531 and the second wrapping portion 532 are arranged one on another without misalignment, and the first through portion 541 and the second through portion 542 are arranged one on another without misalignment.

The first hole 541A and the first wrapping portion 531 are arranged in the elongated direction. Likewise, the second hole 542A and the second wrapping portion 532 are arranged in the elongated direction. Thus, the first hole 541A and the first wrapping portion 531 overlap each other in the first direction, and the second hole 542A and the second wrapping portion 532 overlap each other in the first direction. That is, when viewed in the first direction, the first hole 541A and the first wrapping portion 531 overlap each other, and the second hole 542A and the second wrapping portion 532 overlap each other. This configuration enables the user to pass the wrapping portion 53 through the hole 54A of the through portion 54 by bending the wrapping portion 53 in the elongated direction in the process in which the user attaches the label 51 to the wrapped member K. Since the direction in which the wrapping portion 53 is bent and the direction in which the wrapped member K extends are orthogonal to each other, it is possible to increase the area of contact of the wrapping portion 53 with the wrapped member K, enabling the user to attach the label 51 to the wrapped member K stably.

The tape cassette 6 contains the roll 600 that is formed by rolling the first label medium 60A on the tape spool 72. A second-direction-side end portion of the first label medium 60A is connected to the tape spool 72. During conveyance, the first label medium 60A passes through a position near the thermal head 29 such that a first-direction-side portion of the first label medium 60A passes first. The printing apparatus 1 prints information on the indicator portion 52 (the region 52A) of the label 51 of the first label medium 60A which passes through the position near the thermal head 29. A portion of the first label medium 60A which includes the printed label 51 is discharged from the label output opening 26.

In some case, the printing apparatus 1 is unable to perform printing at the start of the printing on a portion of the first label medium 60A which is located downstream of the position near the thermal head 29, i.e., a portion of the first label medium 60A which is located between the position near the thermal head 29 and a position near the label output opening 26. This is because the above-described portion of the first label medium 60A has already passed through the position near the thermal head 29 and is located downstream of the position near the thermal head 29. This case is not preferable because the printing apparatus 1 cannot efficiently use the first label medium 60A.

In the present embodiment, the first indicator portion 521, the first wrapping portion 531, and the first through portion 541 of the label 51 of the first label medium 60A are arranged in this order in the first direction, and the second indicator portion 522, the second wrapping portion 532, and the second through portion 542 are arranged in this order in the first direction. That is, in the process in which the first label medium 60A is conveyed in printing, the indicator portion 52 of the label 51 passes through the position near the thermal head 29 after the through portion 54 and the wrapping portion 53 of the label 51 pass through the position near the thermal head 29. This configuration reduces a possibility that a portion of the first label medium 60A which is located downstream of the position near the thermal head 29 includes the indicator portion 52 at the start of printing. Accordingly, the printing apparatus 1 can efficiently use the first label medium 60A to print information on the region 52A of the indicator portion 52.

Second Label Medium 60B According to Second Embodiment

Figure 8A:
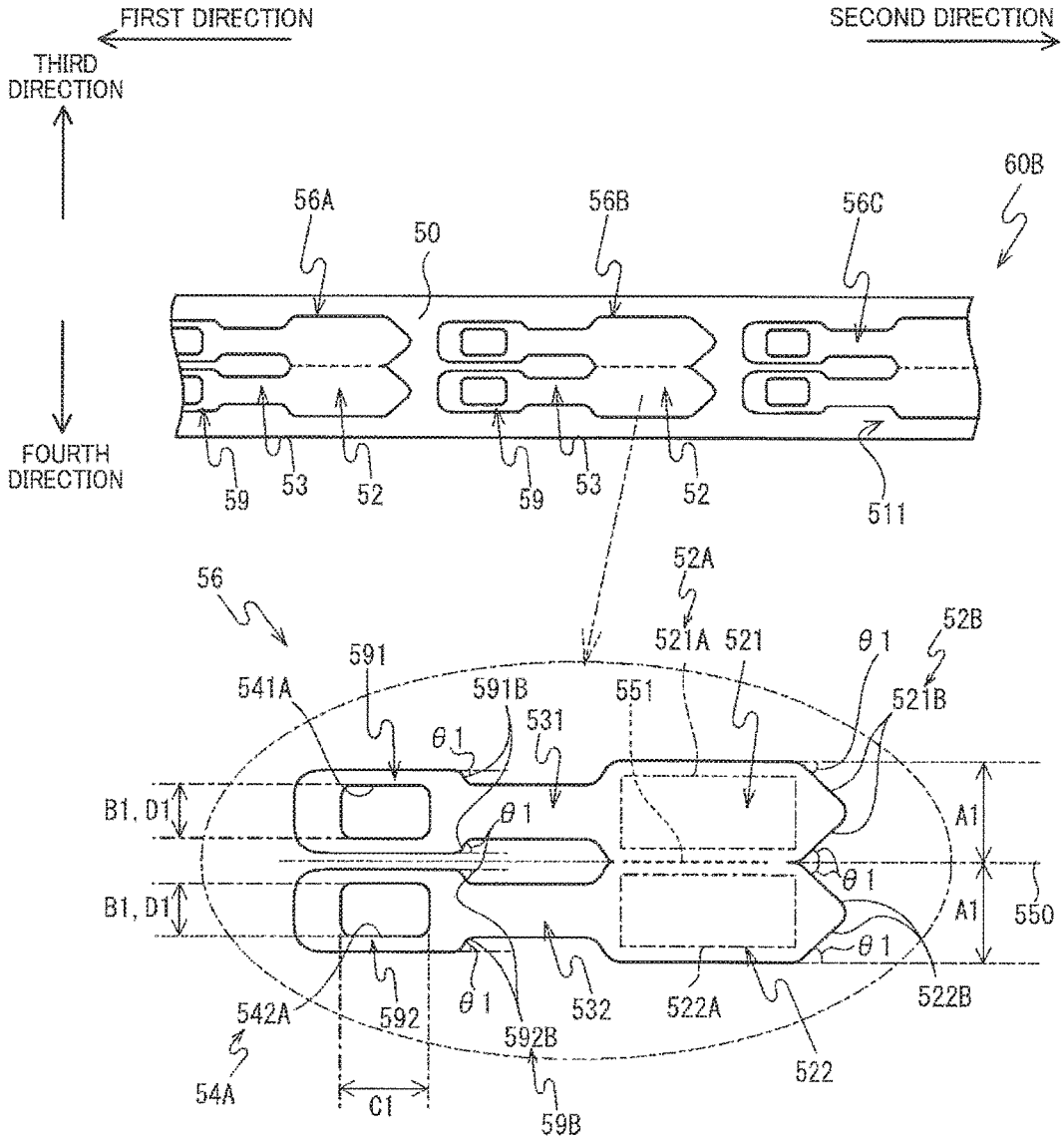
FIGS. 8A and 8B are views of a second label medium.
Figure 8B:
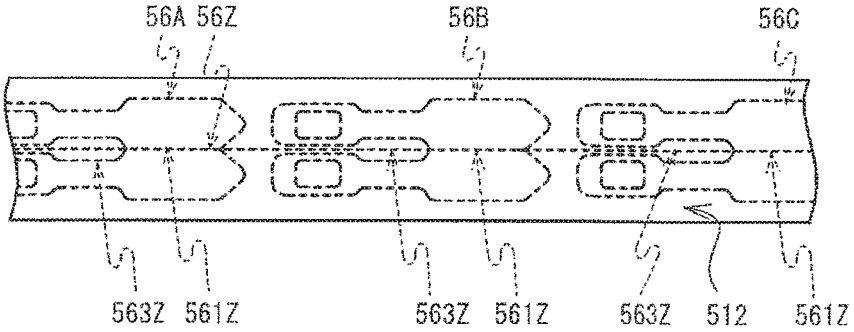

There will be next explained a second label medium 60B according to a second embodiment of the label medium 60 with reference to FIGS. 8A and 8B. The second label medium 60B is different from the first label medium 60A (see FIGS. 5A and 5B) in that the second label medium 60B has through portions 59 instead of the through portions 54 (see FIGS. 5A and 5B). The other configuration of the second label medium 60B is the same as that of the first label medium 60A. Labels 56 (i.e., labels 56A, 56B, 56C, and so on) of the second label medium 60B respectively correspond to the labels 51 (i.e., the labels 51A, 51B, 51C, and so on) of the first label medium 60A. It is noted that the same reference numerals as used in the first label medium 60A are used to designate the corresponding elements of the second label medium 60B, and an explanation of which is dispensed with.

As illustrated in FIG. 8A, the length of the through portion 59 in the orthogonal direction is less than that of the through portion 54. More specifically, the length of the through portion 59 in the orthogonal direction is less than the length A1 of the indicator portion 52 in the orthogonal direction and greater than the length B1 of the wrapping portion 53 in the orthogonal direction. A first through portion 591 and a second through portion 592 respectively correspond to the first through portion 541 and the second through portion 542 of the through portion 54 (see FIG. 5A). A fourth-direction-side end portion of the first through portion 591 and a third-direction-side end portion of the second through portion 592 are arranged in the orthogonal direction with a space therebetween. That is, in the label 56, only the first indicator portion 521 and the second indicator portion 522 are connected to each other at the first line 551 among the first indicator portion 521 and the second indicator portion 522, the first wrapping portion 531 and the second wrapping portion 532, and the first through portion 591 and the second through portion 592. The first through portion 591 has the first hole 541A, and the second through portion 592 has the second hole 542A. The first hole 541A and the second hole 542A are symmetric with respect to the imaginary line 550.

A second-direction-side end portion of the through portion 59 has through-portion tapered portions 59B respectively located on a third-direction side and a fourth-direction side of a portion of the through portion 59 which is connected to the wrapping portion 53. Each of the through-portion tapered portions 59B is inclined with respect to the orthogonal direction. Due to the through-portion tapered portions 59B, the length of the second-direction-side end portion of the through portion 59 in the orthogonal direction decreases so as to be less at a second-direction-side portion (a right portion in FIG. 8A) of the second-direction-side end portion than at a first-direction-side portion (a left portion in FIG. 8A) of the second-direction-side end portion. The through-portion tapered portion 59B of the first through portion 591 will be referred to as "first through-portion tapered portion 591B", and the through-portion tapered portion 59B of the second through portion 592 will be referred to as "second through-portion tapered portion 592B". The angle of inclination of each of the through-portion tapered portions 59B with respect to the second direction is the angle θ1 that is equal to the angle of inclination of each of the indicator tapered portions 52B with respect to the second direction.

As illustrated in FIG. 8B, the mount sheet 512 has perforation 56Z extending straight in the elongated direction. The perforation 56Z extends through positions on the mount sheet 512 which are respectively opposed to the first lines 551 of the labels 56A, 56B, 56C. That is, the perforation 56Z is formed in the mount sheet 512 so as to be opposed to the imaginary line 550. The perforation 56Z includes: perforations 561Z opposed to the respective first lines 551; and perforations 563Z each located between corresponding adjacent two of the perforations 561Z.

Effects in Second Embodiment

In the second label medium 60B, only the first indicator portion 521 and the second indicator portion 522 are connected to each other at the first line 551 in the label 56. The first through portion 591 and the second through portion 592 are spaced from each other and not connected to each other at the line. With this configuration, the lengths of the indicator portion 52 and the through portion 59 in the orthogonal direction are easily made different from each other.

Third Label Medium 60C According to Third Embodiment

Figure 9A:
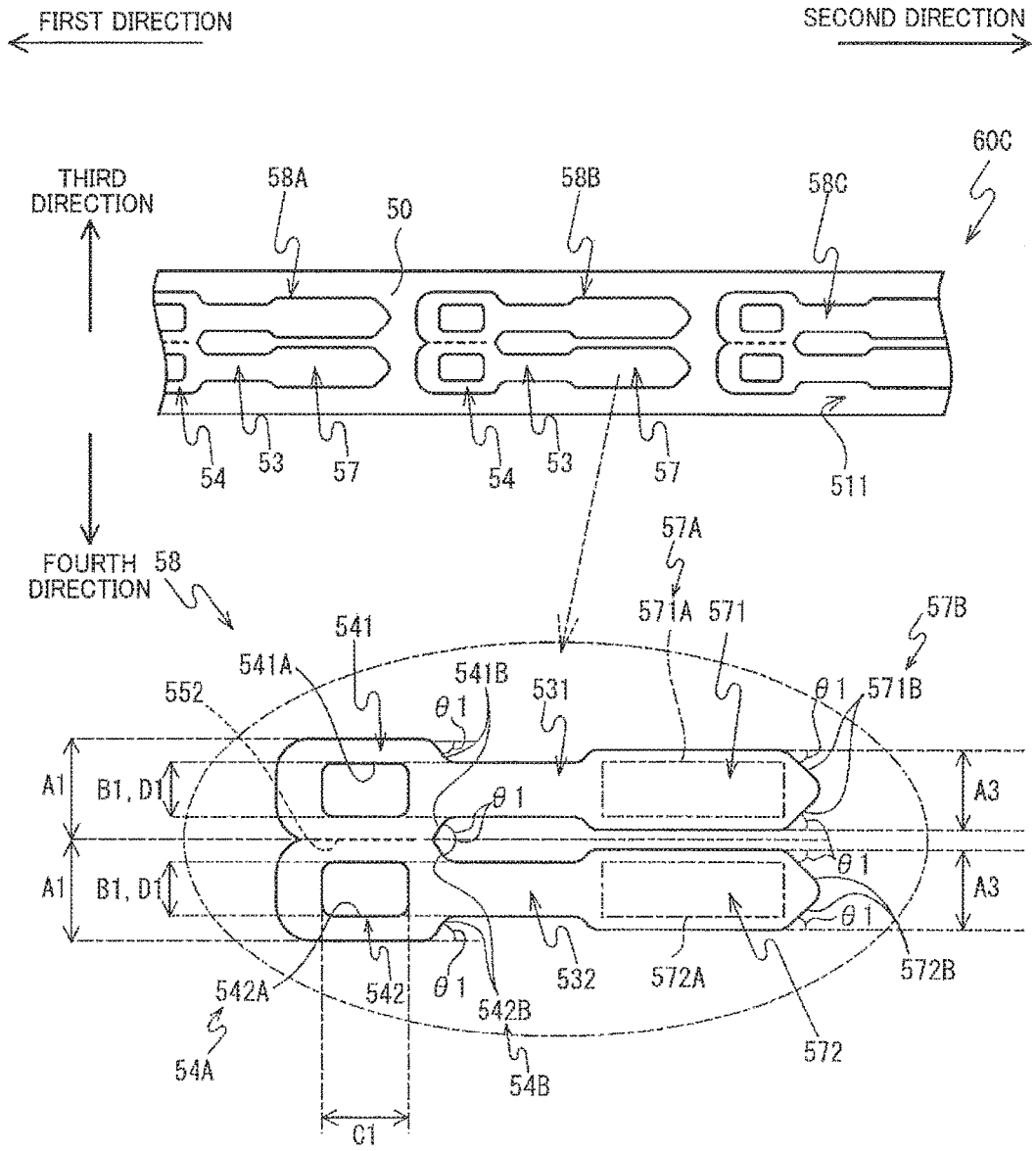
FIGS. 9A and 9B are views of a third label medium.
Figure 9B:
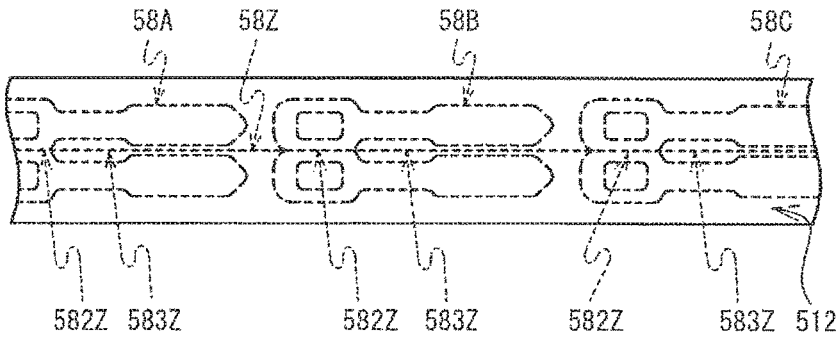

There will be next explained a third label medium 60C according to the third embodiment of the label medium 60 with reference to FIGS. 9A and 9B. The third label medium 60C is different from the first label medium 60A (see FIGS. 5A and 5B) in that the third label medium 60C has indicator portions 57 instead of the indicator portions 52 (see FIG. 5A). The other configuration of the third label medium 60C is the same as that of the first label medium 60A. Labels 58 (i.e., labels 58A, 58B, 58C, and so on) of the third label medium 60C respectively correspond to the labels 51 (i.e., the labels 51A, 51B, 51C, and so on) of the first label medium 60A. It is noted that the same reference numerals as used in the first label medium 60A are used to designate the corresponding elements of the third label medium 60C, and an explanation of which is dispensed with.

As illustrated in FIG. 9A, the length A3 of each of the indicator portions 57 in the orthogonal direction is less than the length A1 (see FIG. 5A) of the indicator portion 52 in the orthogonal direction. More specifically, the length A3 of the indicator portion 57 in the orthogonal direction is less than the length A1 of the through portion 54 in the orthogonal direction and greater than the length B1 of the wrapping portion 53 in the orthogonal direction. A first indicator portion 571 and a second indicator portion 572 respectively correspond to the first indicator portion 521 and the second indicator portion 522 of the indicator portion 52 (see FIG. 5A). A fourth-direction-side end portion of the first indicator portion 571 and a third-direction-side end portion of the second indicator portion 572 are arranged in the orthogonal direction with a space therebetween. That is, in the label 58, only the first through portion 541 and the second through portion 542 are connected to each other at the second line 552 among the first indicator portion 571 and the second indicator portion 572, the first wrapping portion 531 and the second wrapping portion 532, and the first through portion 541 and the second through portion 542. The first indicator portion 571 has a region 571A, and the second indicator portion 572 has a region 572A. Information is printed on the regions 571A, 572A (which may be hereinafter collectively referred to as "region 57A") with the ink transferred from the ink ribbon 613.

A second-direction-side end portion of the indicator portion 57 has indicator tapered portions 57B at opposite end portions of the second-direction-side end portion in the orthogonal direction. Each of the indicator tapered portions 57B is inclined with respect to the orthogonal direction. Due to the indicator tapered portions 57B, the length of the second-direction-side end portion of the indicator portion 57 in the orthogonal direction decreases so as to be less at a second-direction-side portion (a right portion in FIG. 9A) of the second-direction-side end portion than at a first-direction-side portion (a left portion in FIG. 9A) of the second-direction-side end portion. The indicator tapered portion 57B of the first indicator portion 571 will be referred to as "first indicator tapered portion 571B", and the indicator tapered portions 57B of the second indicator portion 572 will be referred to as "second indicator tapered portion 572B". The angle of inclination of each of the indicator tapered portions 57B with respect to the second direction is the angle θ1 that is equal to the angle of inclination of each of the through-portion tapered portions 54B with respect to the second direction.

As illustrated in FIG. 9B, the mount sheet 512 has perforation 58Z extending straight in the elongated direction. The perforation 58Z extends through positions on the mount sheet 512 which are respectively opposed to the second lines 552 of the label 58A, 58B, 58C. That is, the perforation 58Z is formed in the mount sheet 512 so as to be opposed to the imaginary line 550. The perforation 58Z includes: perforations 582Z opposed to the respective second lines 552; and perforations 583Z each located between corresponding adjacent two of the perforations 582Z.

Effects in Third Embodiment

In the third label medium 60C, only the first through portion 541 and the second through portion 542 are connected to each other at the second line 552 in the label 58. The first indicator portion 571 and the second indicator portion 572 are spaced from each other and not connected to each other at the line. With this configuration, as in the second embodiment, the lengths of the indicator portion 57 and the through portion 54 in the orthogonal direction are easily made different from each other.

Fourth Label Medium 60D According to Fourth Embodiment

Figure 10A:
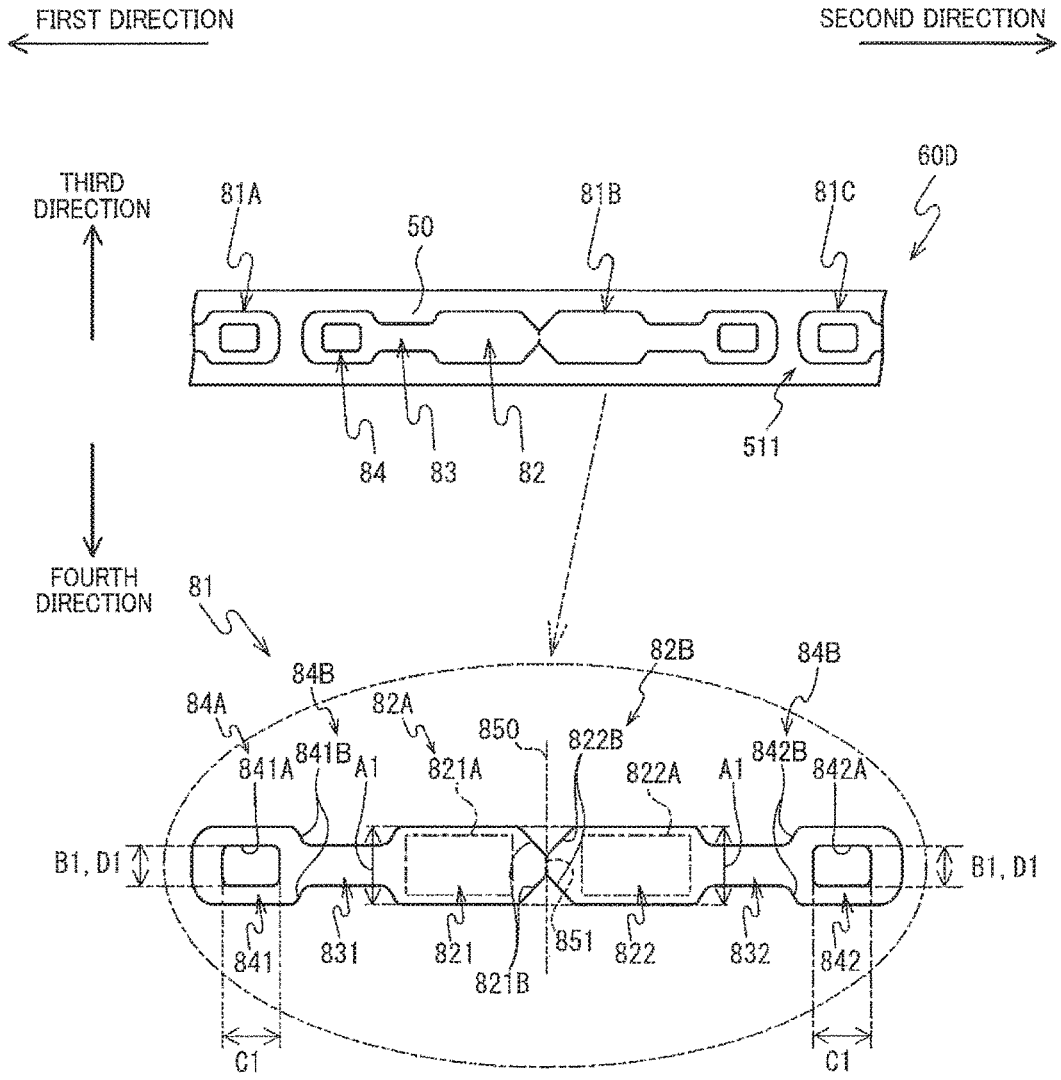
FIGS. 10A and 10B are views of a fourth label medium.
Figure 10B:
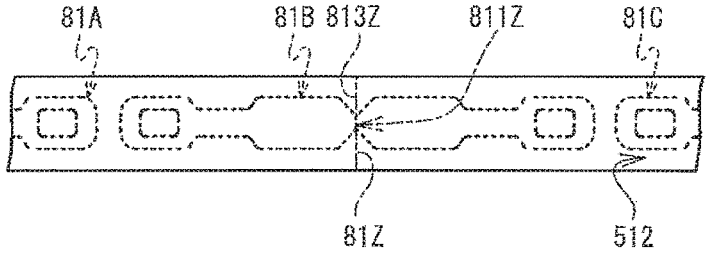

There will be next explained a fourth label medium 60D according to a fourth embodiment of the label medium 60 with reference to FIGS. 10A and 10B. As illustrated in FIG. 10A, the fourth label medium 60D has labels 81A, 81B, 81C, and so on (which may be hereinafter collectively referred to as "label 81"). The label 81 includes a first indicator portion 821, a second indicator portion 822, a first wrapping portion 831, a second wrapping portion 832, a first through portion 841, and a second through portion 842. The shapes and the sizes of first indicator portion 821, the second indicator portion 822, the first wrapping portion 831, the second wrapping portion 832, the first through portion 841, and the second through portion 842 are respectively the same as those of the first indicator portion 521, the second indicator portion 522, the first wrapping portion 531, the second wrapping portion 532, the first through portion 541, and the second through portion 542 (see FIG. 5A) of the label 51 of the first label medium 60A.

The first indicator portion 821 and the second indicator portion 822 may be hereinafter collectively referred to as "indicator portion 82". The indicator portion 82 has the length A1 in the orthogonal direction. The indicator portion 82 has a region 82A on which information is printed with the ink transferred from the ink ribbon 613. The region 82A of the first indicator portion 821 will be referred to as "region 821A", and the region 82A of the second indicator portion 822 will be referred to as "region 822A". The first wrapping portion 831 and the second wrapping portion 832 may be hereinafter collectively referred to as "wrapping portion 83".

The wrapping portion 83 has the length B1 in the orthogonal direction. The first through portion 841 and the second through portion 842 may be hereinafter collectively referred to as "through portion 84". The first through portion 841 has a first hole 841A, and the second through portion 842 has a second hole 842A. The first hole 841A and the second hole 842A may be collectively referred to as "hole 84A". The hole 84A has the length C1 in the elongated direction. The hole 84A has the length D1 in the orthogonal direction. The through portion 84 has through-portion tapered portions 84B corresponding to the through-portion tapered portions 54B. The through-portion tapered portion 84B of the first through portion 841 will be referred to as "first through-portion tapered portion 841B", and the through-portion tapered portions 84B of the second through portion 842 will be referred to as "second through-portion tapered portion 842B".

The first indicator portion 821, the first wrapping portion 831, and the first through portion 841 are connected to each other like the first indicator portion 521, the first wrapping portion 531, and the first through portion 541 (see FIG. 5A) in the label 51 of the first label medium 60A. Also, the elongated direction is the same between the portions 821, 831, 841 and the portions 521, 531, 541. Thus, the first indicator portion 821, the first wrapping portion 831, and the first through portion 841 are arranged in this order in the first direction. The second indicator portion 822, the second wrapping portion 832, and the second through portion 842 are connected to each other like the second indicator portion 522, the second wrapping portion 532, and the second through portion 542 (see FIG. 5A) in the label 51 of the first label medium 60A. The elongated directions are opposite to each other between the portions 822, 832, 842 and the portions 522, 532, 542. Thus, the second indicator portion 822, the second wrapping portion 832, and the second through portion 842 are arranged in this order in the second direction.

The first indicator portion 821, the first wrapping portion 831, and the first through portion 841 are disposed on a first-direction side of the second indicator portion 822, the second wrapping portion 832, and the second through portion 842. The first indicator portion 821 is located on a first-direction side of the second indicator portion 822 with no space therebetween. The second through portion 842, the second wrapping portion 832, the second indicator portion 822, the first indicator portion 821, the first wrapping portion 831, and the first through portion 841 are arranged in this order in the first direction. The first indicator portion 821, the first wrapping portion 831, the first through portion 841, the second indicator portion 822, the second wrapping portion 832, and the second through portion 842 overlap one another in the first direction at their respective regions including their respective centers in the orthogonal direction. That is, when viewed in the first direction, the first indicator portion 821, the first wrapping portion 831, and the first through portion 841 overlap one another at their respective regions including their respective centers in the orthogonal direction, and the second indicator portion 822, the second wrapping portion 832, and the second through portion 842 overlap one another at their respective regions including their respective centers in the orthogonal direction.

A second-direction-side end portion of the first indicator portion 821 and a first-direction-side end portion of the second indicator portion 822 are connected to each other, with a first line 851 located therebetween. The first line 851 extends parallel with the orthogonal direction orthogonal to the elongated direction of the fourth label medium 60D. That is, the first line 851 is a line which is a portion of the substrate 511 and in which perforation that will be described below is formed, and the first line 851 connects the second-direction-side end portion of the first indicator portion 821 and the first-direction-side end portion of the second indicator portion 822 to each other. The first line 851 has an elongated shape. The elongated direction of the first line 851 is parallel with the orthogonal direction and with the third direction. The first line 851 includes the perforation formed in the substrate 511, and the first line 851 and the direction in which the perforation extends are parallel with each other. The perforation formed at the first line 851 is located between the second-direction-side end portion of the first indicator portion 821 and the first-direction-side end portion of the second indicator portion 822, and the direction in which the perforation extends is parallel with the orthogonal direction and with the third direction. The second-direction-side end portion of the first indicator portion 821 includes first indicator tapered portions 821B respectively located on a third-direction side and a fourth-direction side of the first line 851. The first-direction-side end portion of the second indicator portion 822 includes second indicator tapered portion 822B respectively located on a third-direction side and a fourth-direction side of the first line 851. The first indicator tapered portions 821B and the second indicator tapered portion 822B may be collectively referred to as "indicator tapered portion 82B".

The first indicator portion 821 and the second indicator portion 822 are symmetric with respect to an imaginary line 850 extending in the orthogonal direction through the first line 851. The first wrapping portion 831 and the second wrapping portion 832 are symmetric with respect to the imaginary line 850, and the first through portion 841 and the second through portion 842 are symmetric with respect to the imaginary line 850. That is, the imaginary line 850 is an imaginary line extending through the perforation formed at the first line 851. The imaginary line 850 is an imaginary line which is located equidistant from the first indicator portion 821 and the second indicator portion 822 and which extends in the orthogonal direction. Accordingly, the first hole 841A and the second hole 842A are symmetric with respect to the imaginary line 850. It is noted that the first line 851 also serves as a boundary line between the second-direction-side end portion of the first indicator portion 821 and the first-direction-side end portion of the second indicator portion 822.

As illustrated in FIG. 10B, the mount sheet 512 has a plurality of perforations 81Z each extending straight in the orthogonal direction. FIG. 10B illustrates only the perforation 81Z corresponding to the label 81B. The perforation 81Z extends through a position on the mount sheet 512 which is opposed to the first line 851 of the label 81. That is, the perforation 81Z is formed in the mount sheet 512 so as to be opposed to the imaginary line 850. The perforation 81Z includes: perforation 811Z opposed to the first line 851; and perforation 813Z extending from the perforation 811Z in the orthogonal direction.

In the case where the label 81 is attached to the wrapped member K, the user bends the fourth label medium 60D along the perforation 81Z formed in the mount sheet 512 and unbends the fourth label medium 60D to its original shape. This operation creates the bending line on the first line 851 on the substrate 511. The user then peels of the label 81 from the mount sheet 512 of the fourth label medium 60D. The user bends the label 81 along the first line 851 and sticks surfaces of portions of the label 51 which are coated with the adhesive. The first indicator portion 821 and the second indicator portion 822 are stuck to each other without misalignment. Likewise, the first wrapping portion 831 and the second wrapping portion 832 are stuck to each other without misalignment, and the first through portion 841 and the second through portion 842 are stuck to each other without misalignment. The first hole 541A and the second hole 542A are aligned to each other.

Effects in Fourth Embodiment

In the fourth label medium 60D, the first line 851 extends in the orthogonal direction. When the user bends the label 81 along the first line 851, the label 81 is attachable to the wrapped member K. In the label 81, the first indicator portion 821 and the second indicator portion 822 are connected to each other at the first line 851. This configuration reduces misalignment between the first indicator portion 821 and the second indicator portion 822 near the first line 851 when the user bends the label 81 along the first line 851.

In the fourth label medium 60D, the first indicator portion 821, the first wrapping portion 831, the first through portion 841, the second indicator portion 822, the second wrapping portion 832, and the second through portion 842 overlap one another in the first direction at their respective regions including their respective centers in the orthogonal direction. That is, when viewed in the first direction, the first indicator portion 821, the first wrapping portion 831, and the first through portion 841 overlap one another at their respective regions including their respective centers in the orthogonal direction, and the second indicator portion 822, the second wrapping portion 832, and the second through portion 842 overlap one another at their respective regions including their respective centers in the orthogonal direction. With this configuration, it is possible to reduce the length of the label 81 in the orthogonal direction when compared with the first to third embodiments, resulting in reduction in the width of the fourth label medium 60D.

Fifth Label Medium 60E According to Fifth Embodiment

Figure 11A:
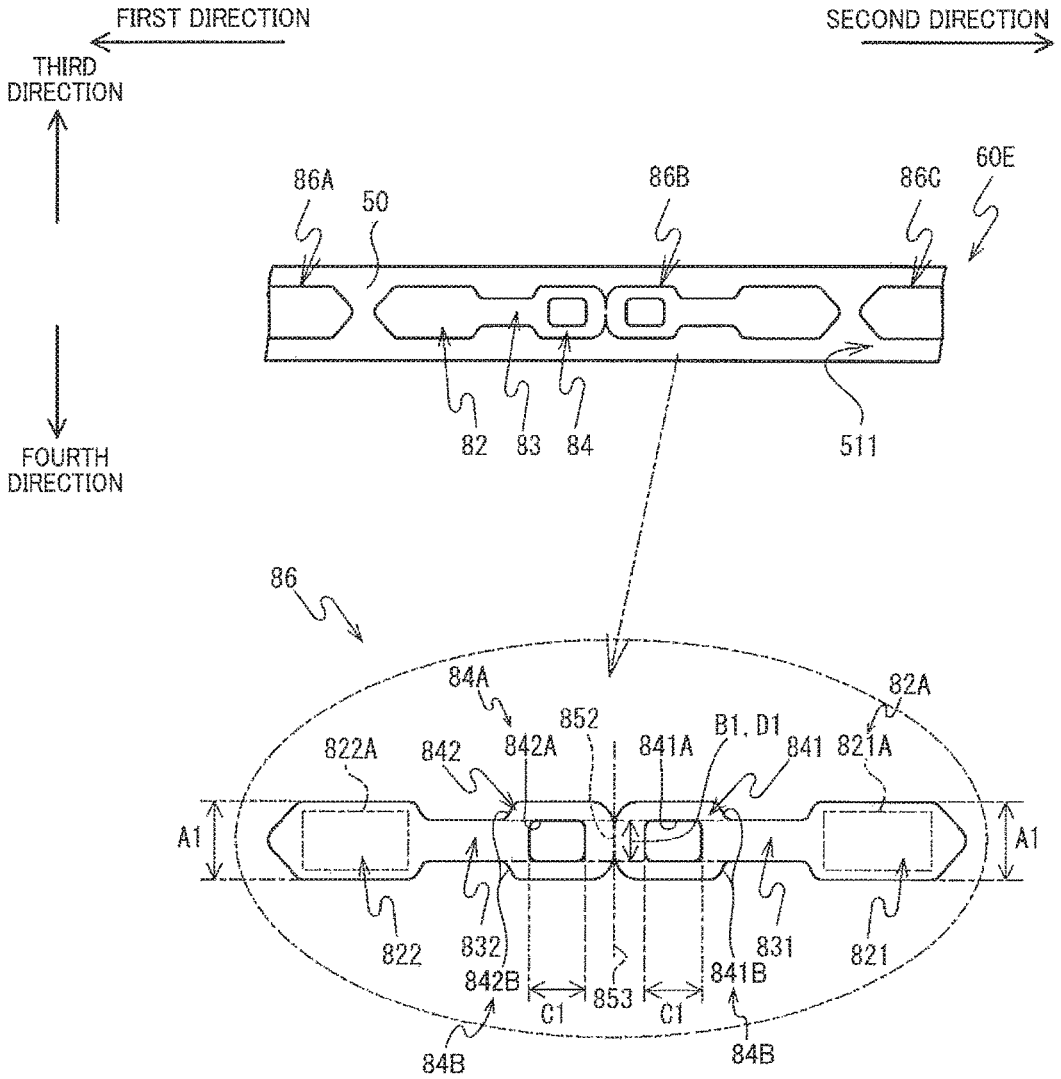
FIGS. 11A and 11B are views of a fifth label medium.
Figure 11B:
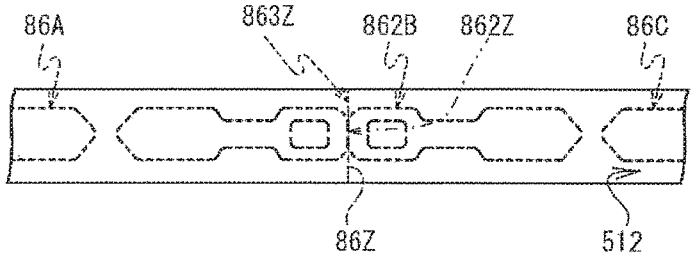

There will be next explained a fifth label medium 60E according to a fifth embodiment of the label medium 60 with reference to FIGS. 11A and 11B. The fifth label medium 60E is different from the fourth label medium 60D (see FIGS. 10A and 10B) in the order of arrangement of the first indicator portion 821, the first wrapping portion 831, the first through portion 841, the second indicator portion 822, the second wrapping portion 832, and the second through portion 842. Labels 86 (labels 86A, 86B, 86C, and so on) of the fifth label medium 60E respectively correspond to the labels 81 (the labels 81A, 81B, 81C, and so on) of the fourth label medium 60D (see FIGS. 10A and 10B).

As illustrated in FIG. 11A, the first indicator portion 821, the first wrapping portion 831, and the first through portion 841 are arranged in this order in the first direction. The second indicator portion 822, the second wrapping portion 832, and the second through portion 842 are arranged in this order in the second direction. The first indicator portion 821, the first wrapping portion 831, and the first through portion 841 are disposed on a second-direction side of the second indicator portion 822, the second wrapping portion 832, and the second through portion 842. The first through portion 841 is disposed on a second-direction side of the second through portion 842 with no space therebetween. The first indicator portion 821, the first wrapping portion 831, the first through portion 841, the second through portion 842, the second wrapping portion 832, and the second indicator portion 822 are arranged in this order in the first direction. The first indicator portion 821, the first wrapping portion 831, the first through portion 841, the second indicator portion 822, the second wrapping portion 832, and the second through portion 842 overlap one another in the first direction at their respective regions including their respective centers in the orthogonal direction. That is, when viewed in the first direction, the first indicator portion 821, the first wrapping portion 831, and the first through portion 841 overlap one another at their respective regions including their respective centers in the orthogonal direction, and the second indicator portion 822, the second wrapping portion 832, and the second through portion 842 overlap one another at their respective regions including their respective centers in the orthogonal direction.

A first-direction-side end portion of the first through portion 841 and a second-direction-side end portion of the second through portion 842 are connected to each other, with a second line 852 located therebetween. The second line 852 extends parallel with the orthogonal direction orthogonal to the elongated direction of the fifth label medium 60E. That is, the second line 852 is a line which is a portion of the substrate 511 and in which perforation that will be described below is formed, and the second line 852 is located between the first-direction-side end portion of the first through portion 841 and the second-direction-side end portion of the second through portion 842 and connects the first through portion 841 and the second through portion 842 to each other. The second line 852 has an elongated shape, and the elongated direction of the second line 852 is parallel with the orthogonal direction and with the third direction. The second line 852 includes the perforation formed in the substrate 511, and the elongated direction of the second line 852 and the direction in which the perforation extends are parallel with each other. The perforation formed in the second line 852 is located between the first-direction-side end portion of the first through portion 841 and the second-direction-side end portion of the second through portion 842, and the direction in which the perforation extends is parallel with the orthogonal direction. The first indicator portion 821 and the second indicator portion 822 are symmetric with respect to an imaginary line 853 extending in the orthogonal direction through the second line 852. Likewise, the first wrapping portion 831 and the second wrapping portion 832 are symmetric with respect to the imaginary line 853, and the first through portion 841 and the second through portion 842 are symmetric with respect to the imaginary line 853. The imaginary line 853 is an imaginary line extending through the perforation formed in the second line 852. The imaginary line 853 is an imaginary line which is located equidistant from the first through portion 841 and the second through portion 842 and which extends parallel with the orthogonal direction. The imaginary line 853 is located equidistant from the first hole 841A and the second hole 842A. Accordingly, the first hole 841A and the second hole 842A are symmetric with respect to the imaginary line 853. It is noted that the second line 852 also serves as a boundary line between the first-direction-side end portion of the first through portion 841 and the second-direction-side end portion of the second through portion 842.

As illustrated in FIG. 11B, the mount sheet 512 has a plurality of perforations 86Z each extending straight in the orthogonal direction. In each of the labels 86B, the perforation 86Z extends through a position on the mount sheet 512 which is opposed to the second line 852 of the label 86. That is, the perforation 86Z is formed in the mount sheet 512 so as to be opposed to the imaginary line 853. The perforation 86Z includes: perforation 862Z opposed to the second line 852; and perforation 863Z extending from the perforation 862Z in the orthogonal direction.

In the case where the user attaches the label 81 to the wrapped member K in the form of a cable, the user bends the fifth label medium 60E along the perforation 86Z formed in the mount sheet 512 and unbends the fifth label medium 60E to its original shape. This operation creates the bending line on the second line 852 on the substrate 511. The user peels off the label 86 from the mount sheet 512 of the fifth label medium 60E. The user bends the label 86 along the second line 852 and sticks surfaces of portions of the label 81 which are coated with the adhesive.

Effects in Fifth Embodiment

In the label 86, the first through portion 841 and the second through portion 842 are connected to each other at the second line 852. This configuration reduces misalignment between the first through portion 841 and the second through portion 842 near the second line 852 when the user bends the label 86 along the second line 852. In the fifth embodiment, misalignment between the first hole 841A and the second hole 842A is reduced when compared with the fourth embodiment. This enables the user to appropriately pass the indicator portion 82 and the wrapping portion 83 through the hole 84A in the process in which the user attaches the label 86 to the wrapped member K.

Sixth Label Medium 60F According to Sixth Embodiment

There will be next explained a sixth label medium 60F according to a sixth embodiment of the label medium 60 with reference to FIG. 12. The sixth label medium 60F is different from the first label medium 60A (see FIGS. 5A and 5B) in that the sixth label medium 60F has wrapping portions 93 and through portions 94 instead of the wrapping portion 53 and the through portion 54 (see FIG. 5A). The other configuration of the sixth label medium 60F is the same as that of the first label medium 60A. Labels 91 (i.e., labels 91A, 91B, 91C, and so on) of the sixth label medium 60F respectively correspond to the labels 51 (i.e., the labels 51A, 51B, 51C, and so on) of the first label medium 60A. It is noted that the same reference numerals as used in the first label medium 60A are used to designate the corresponding elements of the sixth label medium 60F, and an explanation of which is dispensed with.

Figure 12A:
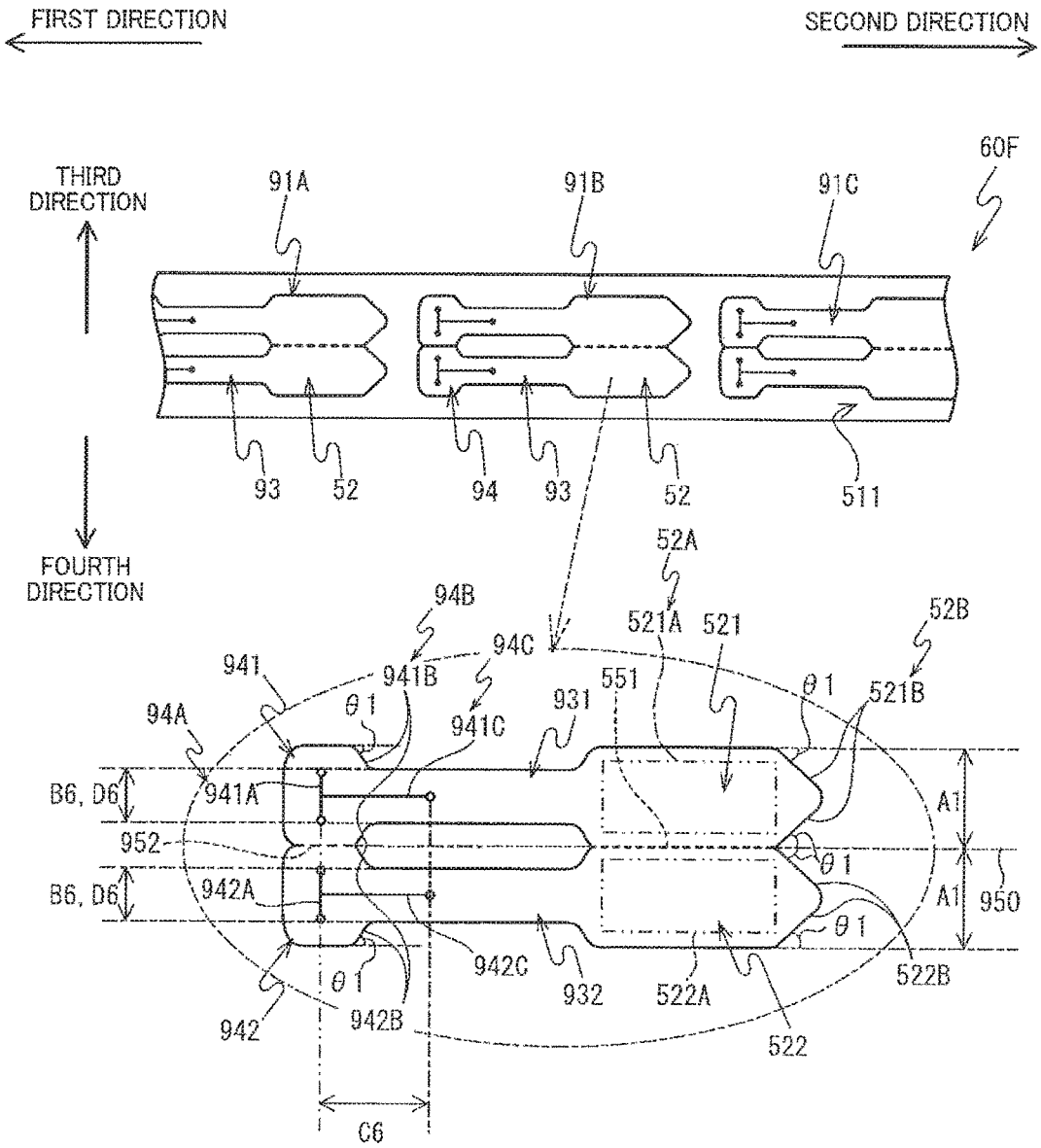
FIGS. 12A and 12B are views of a sixth label medium.

As illustrated in FIG. 12A, the length of the wrapping portion 93 in the elongated direction is greater than that of the wrapping portion 53 in the elongated direction. The length of the through portion 94 in the elongated direction is less than that of the through portion 54 in the elongated direction. A first wrapping portion 931 and a second wrapping portion 932 respectively correspond to the first wrapping portion 531 and the second wrapping portion 532 of the wrapping portion 53 (see FIG. 5A). The length of the wrapping portion 53 in the orthogonal direction is a length B6. The first through portion 591 and the second through portion 592 respectively correspond to the first through portion 541 and the second through portion 542 of the through portion 54 (see FIG. 5A). A fourth-direction-side end portion of a first through portion 941 and a third-direction-side end portion of a second through portion 942 are connected to each other at a second line 952. The second line 952 extends parallel with the elongated direction of the sixth label medium 60F. That is, the second line 952 is a line which is a portion of the substrate 511 and in which perforation that will be described below is formed, and the second line 952 is located between a fourth-direction-side end portion of the first through portion 941 and a third-direction-side end portion of the second through portion 942 which will be described below and connects the first through portion 941 and the second through portion 942 to each other. The second line 952 has an elongated shape, and the elongated direction of the second line 952 is parallel with the elongated direction of the sixth label medium 60F and with the first direction. The second line 952 includes the perforation formed in the substrate 511, and the elongated direction of the second line 952 and the direction in which the perforation extends are parallel with each other. The perforation formed in the second line 952 is located between the fourth-direction-side end portion of the first through portion 941 and the third-direction-side end portion of the second through portion 942, and the direction in which the perforation extends is parallel with the elongated direction of the sixth label medium 60F and with the first direction. The second line 952 and the first line 551 extend on the same straight line. A line extending straight in the elongated direction through the first line 551 and the second line 952 is defined as an imaginary line 950. That is, the imaginary line 950 is an imaginary line extending through the perforation formed in the second line 952. Also, the imaginary line 950 is located equidistant from the first through portion 941 and the second through portion 942 and extends in the direction parallel with the elongated direction of the sixth label medium 60F. Thus, the first through portion 941 and the second through portion 942 are symmetric with respect to the imaginary line 950. A first slit 941A formed in the first through portion 941 which will be described below and a second slit 942A formed in the second through portion 942 are symmetric with respect to the imaginary line 950. Likewise, a first slit 941C formed in the first through portion 941 which will be described below and a second slit 942C formed in the second through portion 942 are symmetric with respect to the imaginary line 950. It is noted that the second line 952 also serves as a boundary line between the fourth-direction-side end portion of the first through portion 941 and the third-direction-side end portion of the second through portion 942.

The first through portion 941 has the first slit 941A. The second through portion 942 has the second slit 942A. Each of the first slit 941A and the second slit 942A extends in the orthogonal direction. The first slit 941A and the second slit 942A are symmetric with respect to the imaginary line 950. The length of each of the first slit 941A and the second slit 942A in the orthogonal direction is a length D6 that is equal to the length B6 of the wrapping portion 93 in the orthogonal direction.

The first slit 941C is formed over a portion of the first through portion 941 and a portion of the first wrapping portion 931. The first slit 941C extends in the second direction, from the center of the first slit 941A in the orthogonal direction, through the centers of the first through portion 941 and the first wrapping portion 931 in the orthogonal direction. The second slit 942C is formed over a portion of the second through portion 942 and a portion of the second wrapping portion 932. The second slit 942C extends in the second direction, from the center of the second slit 942A in the orthogonal direction, through the centers of the second through portion 942 and the second wrapping portion 932 in the orthogonal direction. The first slit 941C and the second slit 942C are symmetric with respect to the imaginary line 950. The length of each of the first slit 941C and the second slit 942C in the elongated direction is a length C6 that is equal to the length A1 of the indicator portion 52 in the orthogonal direction. The first slit 941A and the second slit 942A may be collectively referred to as "slit 94A", and the first slit 941C and the second slit 942C may be collectively referred to as "slit 94C".

A second-direction-side end portion of the through portion 94 has through-portion tapered portions 94B respectively located on a third-direction side and a fourth-direction side of a portion of the through portion 94 which is connected to the wrapping portion 93. Each of the through-portion tapered portions 94B is inclined with respect to the orthogonal direction. Due to the through-portion tapered portions 94B, the length of the second-direction-side end portion of the through portion 94 in the orthogonal direction decreases so as to be less at a second-direction-side portion (a right portion in FIG. 12A) of the second-direction-side end portion than at a first-direction-side portion (a left portion in FIG. 12A) of the second-direction-side end portion. The through-portion tapered portion 94B of the first through portion 941 will be referred to as "first through-portion tapered portion 941B", and the through-portion tapered portion 94B of the second through portion 942 will be referred to as "second through-portion tapered portion 942B". The angle of inclination of each of the through-portion tapered portions 94B with respect to the second direction is the length θ1 that is equal to the angle of inclination of each of the indicator tapered portions 52B with respect to the second direction.

Figure 12B:
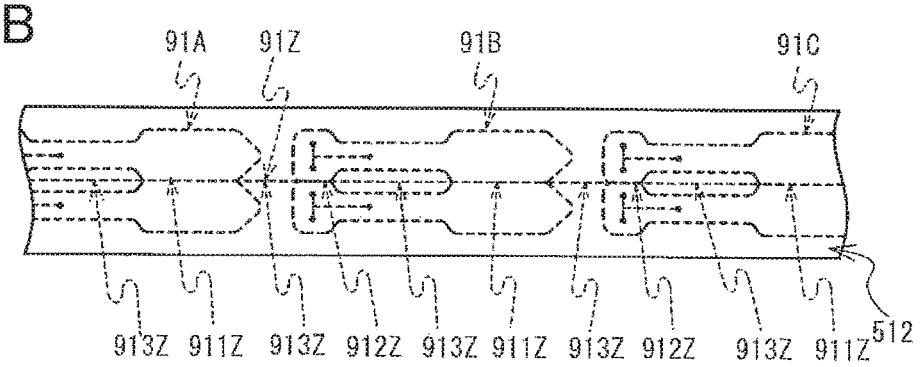

As illustrated in FIG. 12B, in each of the labels 91, the mount sheet 512 has perforation 91Z extending straight in the elongated direction. The perforation 91Z extends through positions on the mount sheet 512 which are respectively opposed to the first lines 551 and the second lines 952 of the labels 91A, 91B, 91C. That is, the perforation 91Z is formed in the mount sheet 512 so as to be opposed to the imaginary line 950. The perforation 91Z includes: perforations 911Z opposed to the respective first lines 551; perforations 912Z opposed to the respective second lines 952; and perforations 913Z each located between corresponding adjacent two the perforations 911Z, 912Z.

In the case where the user attaches the label 91 to the wrapped member K, the user bends the label 91 along the first line 551 and the second line 952 and sticks surfaces of portions of the label 91 which are coated with the adhesive. Here, the first indicator portion 521 and the second indicator portion 522 are stuck to each other without misalignment. Likewise, the first wrapping portion 931 and the second wrapping portion 932 are stuck to each other without misalignment, and the first through portion 941 and the second through portion 942 are stuck to each other without misalignment. The first slit 941A and the second slit 942A are aligned to each other, and the first slit 941C and the second slit 942C are aligned to each other.

The user bends the wrapping portion 93 by twisting and passes the indicator portion 52 through the slit 94C of the through portion 94. The user then untwists the wrapping portion 93 and passes the wrapping portion 93 through the slit 94A of the through portion 94. As a result, the wrapping portion 93 is wrapped around the wrapped member K. The user then pulls the indicator portion 52 and the wrapping portion 93 to tighten the wrapping portion 93 on the wrapped member K. As a result, the attachment of the label 91 to the wrapped member K is complete.

Effects in Sixth Embodiment

In the label 91, the length C6 of the slit 94C in the elongated direction is equal to the length A1 of the indicator portion 52 in the orthogonal direction. This configuration enables the user to pass the indicator portion 52 through the slit 94C in a state in which the indicator portion 52 is stretched in the process in which the user attaches the label 91 to the wrapped member K. Accordingly, the user can easily pass the indicator portion 52 through the slit 94C, whereby the user can easily attach the label 91 to the wrapped member K.

The length D6 of the slit 94A of the through portion 54 in the orthogonal direction is equal to the length B6 of the wrapping portion 93 in the orthogonal direction. This configuration reduces bending of the wrapping portion 93 in the state in which the label 91 is held on the wrapped member K. Thus, the user can firmly hold the label 91 on the wrapped member K.

Modifications

While the embodiments have been described above, it is to be understood that the disclosure is not limited to the details of the illustrated embodiments, but may be embodied with various changes and modifications, which may occur to those skilled in the art, without departing from the spirit and scope of the disclosure. The following explanation is provided by taking the first label medium 60A (the label 51) in the first embodiment as an example, unless otherwise specified. However, similar modifications may be applied to the other embodiments (the second to sixth embodiments).

For example, the wording "equal to" in the above-described description includes not only the wording "completely equal to" but also the wording "substantially equal to". Thus, the length A1 of the indicator portion 52 in the orthogonal direction and the length C1 of the hole 54A of the through portion 54 in the elongated direction only needs to be substantially equal to each other and may be different from each other strictly, for example. Likewise, the length B1 of the wrapping portion 53 in the orthogonal direction and the length D1 of the hole 54A of the through portion 54 in the orthogonal direction only needs to be substantially equal to each other and may be different from each other strictly. Likewise, the wording "symmetric with respect to the imaginary line 550" includes not only the wording "strictly symmetric with respect to the imaginary line 550" but also the wording "substantially symmetric with respect to the imaginary line 550". Thus, the shape of the first indicator portion 521 and the second indicator portion 522 may be slightly different from the symmetric shape with respect to the imaginary line 550, for example. This may be applied to the first wrapping portion 531 and the second wrapping portion 532, the first through portion 541 and the second through portion 542, and the first hole 541A and the second hole 542A.

The length A1 of the indicator portion 52 in the orthogonal direction may be less than the length C1 of the hole 54A of the through portion 54 in the elongated direction. In this case, the user can more easily pass the indicator portion 52 through the hole 54A of the through portion 54. The length B1 of the wrapping portion 53 in the orthogonal direction may be less than the length D1 of the hole 54A of the through portion 54 in the orthogonal direction. This configuration can reduce bending of the wrapping portion 53 in the state in which the wrapping portion 53 passes through the through portion 54.

The mount sheet 512 may have slits instead of the perforation 51Z. The perforation 51Z formed in the mount sheet 512 may be formed so as to be opposed to only the first line 551 on the label 51 and may be formed so as to be opposed to only the second line 552. The substrate 511 need not have the frame portion 50. That is, only the labels 51 may be stuck to the mount sheet 512. In this case, the mount sheet 512 has: a first region at which the labels 51 are stuck to the mount sheet 512; and a second region at which the labels 51 are not stuck to the mount sheet 512. This configuration enables the user to easily peel off the label 51 from the mount sheet 512.

The length of the wrapping portion 53 in the orthogonal direction may be the length A1 that is the length of each of the indicator portion 52 and the through portion 54 in the orthogonal direction. That is, the lengths of the indicator portion 52, the wrapping portion 53, and the through portion 54 in the orthogonal direction may be equal to each other. In this case, the first indicator portion 521, the first wrapping portion 531, and the first through portion 541 completely overlap each other in the first direction at their respective entire regions in the orthogonal direction. The second indicator portion 522, the second wrapping portion 532, and the second through portion 542 completely overlap each other in the first direction at their respective entire regions in the orthogonal direction. That is, when viewed in the first direction, the first indicator portion 521, the first wrapping portion 531, and the first through portion 541 completely overlap each other at their respective entire regions in the orthogonal direction, and the second indicator portion 522, the second wrapping portion 532, and the second through portion 542 completely overlap each other at their respective entire regions in the orthogonal direction. The first indicator portion 521, the first wrapping portion 531, and the first through portion 541 may not overlap each other in the first direction. Likewise, the second indicator portion 522, the second wrapping portion 532, and the second through portion 542 may not overlap each other in the first direction. The first wrapping portion 531 and the second wrapping portion 532 may be connected to each other at a line formed by perforation.

The first indicator portion 521 and the second indicator portion 522 only need to be at least partly symmetric with respect to the imaginary line 550. The first indicator portion 521 and the second indicator portion 522 may be different from each other in shape. The first wrapping portion 531 and the second wrapping portion 532 only need to be at least partly symmetric with respect to the imaginary line 550. Each of the first through portion 541 and the second through portion 542 may be different from each other in shape. In this case, the first through portion 541 and the second through portion 542 only need to be at least partly symmetric with respect to the second line 552. The first hole 541A and the second hole 542A may be different from each other in shape. In this case, the first hole 541A, the second hole 542A only need to be at least partly symmetric with respect to the second line 552. The through portion 54 may have slits in addition to the hole 54A. The through portion 94 may have slits in addition to the slits 94A, 94C.

Each of the first line 551 and the second line 552 may extend in a direction intersecting the elongated direction. The first line 551 and the second line 552 may not extend on the same straight line. Each of the first line 851 and the second line 852 may extend in a direction intersecting the orthogonal direction.

The indicator tapered portions 52B of the indicator portion 52 may be asymmetrical with respect to the imaginary line 550. The indicator portion 52 may not have the indicator tapered portions 52B. That is, the end portion of the indicator portion 52 which is farther from the wrapping portion 53 may have a length in the orthogonal direction which is equal to the longest length of the indicator portion 52 in the orthogonal direction. The through-portion tapered portions 54B of the through portion 54 may be asymmetrical with respect to the imaginary line 550. The through portion 54 may not have the through-portion tapered portions 54B. That is, the end portion of the through portion 54 which is farther from the wrapping portion 53 may have a length in the orthogonal direction which is equal to the longest length of the through portion 54 in the orthogonal direction.

The indicator portion 52, the wrapping portion 53, and the through portion 54 may be arranged in this order in the direction directed toward the end portion of the first label medium 60A which is connected to the tape spool 72. The order of arrangement of the indicator portion 52, the wrapping portion 53, and the through portion 54 may vary among the labels 51.

In the fourth embodiment, the length of the wrapping portion 83 in the orthogonal direction may be equal to the length A1 of each of the indicator portion 82 and the through portion 84 in the orthogonal direction. That is, the lengths of the indicator portion 82, the wrapping portion 83, and the through portion 84 in the orthogonal direction may be equal to each other. In this case, the first indicator portion 821, the first wrapping portion 831, the first through portion 841, the second indicator portion 822, the second wrapping portion 832, and the second through portion 842 completely overlap each other in the first direction at their respective entire regions in the orthogonal direction. That is, when viewed in the first direction, the first indicator portion 821, the first wrapping portion 831, the first through portion 841 completely overlap each other at their respective entire regions in the orthogonal direction, and the second indicator portion 822, the second wrapping portion 832, and the second through portion 842 completely overlap each other at their respective entire regions in the orthogonal direction. The first indicator portion 821, the first wrapping portion 831, the first through portion 841, the second indicator portion 822, the second wrapping portion 832, and the second through portion 842 may not overlap each other in the first direction.

The labels 51A, 51B, 51C, and so on may be arranged in the orthogonal direction. The indicator portion 52, the wrapping portion 53, and the through portion 54 may be arranged in this order in the orthogonal direction. Each of the substrate 511 and the mount sheet 512 may not have an elongated shape. Each of the lines 551, 552 is not limited to the perforation. For example, each of the lines 551, 552 may be a straight line or a broken line printed on the substrate 511 in advance.

In the sixth embodiment, each of the slits 94A, 94C may be formed only in the through portion 94. That is, the slit 94C may extend in the elongated direction only on the region of the through portion 94 without formed in the wrapping portion 93.

What is claimed is:

1. A label medium, comprising:

a mount sheet; and a label stuck to the mount sheet and comprising (i) a first indicator portion and a second indicator portion, each comprising a region on which information is printable, (ii) a first wrapping portion and a second wrapping portion to be wrapped on a wrapped member, (iii) a first through portion having at least a portion of a first hole or a first slit through which the first indicator portion and the second indicator portion are to be passed, and (iv) a second through portion having at least a portion of a second hole or a second slit through which the first indicator portion and the second indicator portion are to be passed, wherein the first indicator portion, the first wrapping portion, and the first through portion are arranged in order of the first indicator portion, the first wrapping portion, and the first through portion in a first direction parallel with a surface of the mount sheet, wherein the second indicator portion, the second wrapping portion, and the second through portion are arranged in order of the second indicator portion, the second wrapping portion, and the second through portion in one of the first direction and a second direction opposed to the first direction, wherein (a) the first indicator portion and the second indicator portion, (b) the first wrapping portion and the second wrapping portion, or (c) the first through portion and the second through portion, are at least connected to each other via a line, wherein at least a portion of the first indicator portion and at least a portion of the second indicator portion are symmetric with respect to an imaginary line extending along the line, wherein at least a portion of the first wrapping portion and at least a portion of the second wrapping portion are symmetric with respect to the imaginary line, wherein at least a portion of the first through portion and at least a portion of the second through portion are symmetric with respect to the imaginary line, wherein at least a portion of the first hole or the first slit and at least a portion of the second hole or the second slit are symmetric with respect to the imaginary line, wherein the line extends parallel with the first direction, wherein the first indicator portion and the second indicator portion are connected to each other via a first line, wherein the first through portion and the second through portion are connected to each other via a second line, and the first line and the second line extend on an identical straight line, and wherein perforation or a slit is formed in the mount sheet at a position opposed to each of the first line and the second line.

2. The label medium according to claim 1, wherein a first perforation, a second perforation, a third perforation, and a third slit are formed in the mount sheet such that the third perforation or the third slit is formed between the first perforation or the first slit opposed to the first line and the second perforation or the second slit opposed to the second line.

3. The label medium according to claim 1, wherein at least a portion of the first indicator portion, at least a portion of the first wrapping portion, and at least a portion of the first through portion are aligned along a common axis parallel to the first direction, and wherein at least a portion of the second indicator portion, at least a portion of the second wrapping portion, and at least a portion of the second through portion are aligned along a common axis parallel to the first direction.

4. The label medium according to claim 1, wherein a length of the first indicator portion in a direction orthogonal to the first direction is less than or equal to a length of the first hole or the first slit in the first direction, and wherein a length of the second indicator portion in the direction orthogonal to the first direction is less than or equal to a length of the second hole or the second slit in the first direction.

5. The label medium according to claim 4, wherein the length of the first hole or the first slit in the first direction is equal to the length of the first indicator portion in the direction orthogonal to the first direction, and wherein the length of the second hole or the second slit in the first direction is equal to the length of the second indicator portion in the direction orthogonal to the first direction.

6. The label medium according to claim 1, wherein a length of the first wrapping portion in a direction orthogonal to the first direction is less than or equal to a length of the first hole or the first slit in the direction orthogonal to the first direction, and wherein a length of the second wrapping portion in the direction orthogonal to the first direction is less than or equal to a length of the second hole or the second slit in the direction orthogonal to the first direction.

7. The label medium according to claim 6, wherein the length of the first hole or the first slit in the direction orthogonal to the first direction is equal to a length of the first wrapping portion in the direction orthogonal to the first direction, and wherein the length of the second hole or the second slit in the direction orthogonal to the first direction is equal to the length of the second wrapping portion in the direction orthogonal to the first direction.

8. The label medium according to claim 1, wherein the first wrapping portion is less than each of the first indicator portion and the first through portion in length in a direction orthogonal to the first direction, and wherein the second wrapping portion is less than each of the second indicator portion and the second through portion in length in the direction orthogonal to the first direction.

9. The label medium according to claim 1, wherein a shape and a size of the first indicator portion are respectively identical to a shape and a size of the second indicator portion, wherein a shape and a size of the first wrapping portion are respectively identical to a shape and a size of the second wrapping portion, and wherein a shape and a size of the first through portion are respectively identical to a shape and a size of the second through portion.

10. The label medium according to claim 1, wherein the first wrapping portion and at least a portion of the first hole or the first slit are aligned along a common axis parallel to the first direction, and wherein the second wrapping portion and at least a portion of the second hole or the second slit are aligned along a common axis parallel to the first direction.

11. A cassette containing a roll that is formed by winding the label medium according to claim 1 around a spool.

12. A label medium, comprising:

a mount sheet; and a label stuck to the mount sheet and comprising (i) a first indicator portion and a second indicator portion, each comprising a region on which information is printable, (ii) a first wrapping portion and a second wrapping portion to be wrapped on a wrapped member, (iii) a first through portion having at least a portion of a first hole or a first slit through which the first indicator portion and the second indicator portion are to be passed, and (iv) a second through portion having at least a portion of a second hole or a second slit through which the first indicator portion and the second indicator portion are to be passed, wherein the first indicator portion, the first wrapping portion, and the first through portion are arranged in order of the first indicator portion, the first wrapping portion, and the first through portion in a first direction parallel with a surface of the mount sheet, wherein the second indicator portion, the second wrapping portion, and the second through portion are arranged in order of the second indicator portion, the second wrapping portion, and the second through portion in one of the first direction and a second direction opposed to the first direction, wherein (a) the first indicator portion and the second indicator portion, (b) the first wrapping portion and the second wrapping portion, or (c) the first through portion and the second through portion, are at least connected to each other via a line, wherein at least a portion of the first indicator portion and at least a portion of the second indicator portion are symmetric with respect to an imaginary line extending along the line, wherein at least a portion of the first wrapping portion and at least a portion of the second wrapping portion are symmetrical with respect to the imaginary line, wherein at least a portion of the first through portion and at least a portion of the second through portion are symmetric with respect to the imaginary line, and wherein at least a portion of the first hole or the first slit and at least a portion of the second hole or the second slit are symmetric with respect to the imaginary line, wherein the line extends parallel with the first direction, and wherein only the first through portion and the second through portion are connected to each other via the line among the first indicator portion and the second indicator portion, the first wrapping portion and the second wrapping portion, and the first through portion and the second through portion.

13. The label medium according to claim 12, wherein at least a portion of the first indicator portion, at least a portion of the first wrapping portion, and at least a portion of the first through portion are aligned along a common axis parallel to the first direction, and wherein at least a portion of the second indicator portion, at least a portion of the second wrapping portion, and at least a portion of the second through portion are aligned along a common axis parallel to the first direction.

14. The label medium according to claim 12, wherein a length of the first indicator portion in a direction orthogonal to the first direction is less than or equal to a length of the first hole or the first slit in the first direction, and wherein a length of the second indicator portion in the direction orthogonal to the first direction is less than or equal to a length of the second hole or the second slit in the first direction.

15. The label medium according to claim 14, wherein the length of the first hole or the first slit in the first direction is equal to the length of the first indicator portion in the direction orthogonal to the first direction, and wherein the length of the second hole or the second slit in the first direction is equal to the length of the second indicator portion in the direction orthogonal to the first direction.

16. The label medium according to claim 12, wherein a length of the first wrapping portion in a direction orthogonal to the first direction is less than or equal to a length of the first hole or the first slit in the direction orthogonal to the first direction, and wherein a length of the second wrapping portion in the direction orthogonal to the first direction is less than or equal to a length of the second hole or the second slit in the direction orthogonal to the first direction.

17. The label medium according to claim 16, wherein the length of the first hole or the first slit in the direction orthogonal to the first direction is equal to a length of the first wrapping portion in the direction orthogonal to the first direction, and wherein the length of the second hole or the second slit in the direction orthogonal to the first direction is equal to the length of the second wrapping portion in the direction orthogonal to the first direction.

18. The label medium according to claim 12, wherein the first wrapping portion is less than each of the first indicator portion and the first through portion in length in a direction orthogonal to the first direction, and wherein the second wrapping portion is less than each of the second indicator portion and the second through portion in length in the direction orthogonal to the first direction.

19. The label medium according to claim 12, wherein a shape and a size of the first indicator portion are respectively identical to a shape and a size of the second indicator portion, wherein a shape and a size of the first wrapping portion are respectively identical to a shape and a size of the second wrapping portion, and wherein a shape and a size of the first through portion are respectively identical to a shape and a size of the second through portion.

20. The label medium according to claim 12, wherein the first wrapping portion and at least a portion of the first hole or the first slit are aligned along a common axis parallel to the first direction, and wherein the second wrapping portion and at least a portion of the second hole or the second slit are aligned along a common axis parallel to the first direction.

21. A cassette containing a roll that is formed by winding the label medium according to claim 12 around a spool.

22. A label medium, comprising:

a mount sheet; and a label stuck to the mount sheet and comprising (i) a first indicator portion and a second indicator portion, each comprising a region on which information is printable, (ii) a first wrapping portion and a second wrapping portion to be wrapped on a wrapped member, (iii) a first through portion having at least a portion of a first hole or a first slit through which the first indicator portion and the second indicator portion are to be passed, and (iv) a second through portion having at least a portion of a second hole or a second slit through which the first indicator portion and the second indicator portion are to be passed, wherein the first indicator portion, the first wrapping portion, and the first through portion are arranged in order of the first indicator portion, the first wrapping portion, and the first through portion in a first direction parallel with a surface of the mount sheet, wherein the second indicator portion, the second wrapping portion, and the second through portion are arranged in order of the second indicator portion, the second wrapping portion, and the second through portion in one of the first direction and a second direction opposed to the first direction, wherein (a) the first indicator portion and the second indicator portion, (b) the first wrapping portion and the second wrapping portion, or (c) the first through portion and the second through portion, are at least connected to each other via a line, wherein at least a portion of the first indicator portion and at least a portion of the second indicator portion are symmetric with respect to an imaginary line extending along the line, wherein at least a portion of the first wrapping portion and at least a portion of the second wrapping portion are symmetric with respect to the imaginary line, wherein at least a portion of the first through portion and at least a portion of the second through portion are symmetric with respect to the imaginary line, and wherein at least a portion of the first hole or the first slit and at least a portion of the second hole or the second slit are symmetric with respect to the imaginary line, wherein one of opposite end portions of the first indicator portion which one is further from the first wrapping portion than the other comprises a first indicator tapered portion, and a length of the first indicator tapered portion in a direction orthogonal to the first direction decreases with increase in distance from the first wrapping portion, wherein one of opposite end portions of the second indicator portion which one is further from the second wrapping portion than the other comprises a second indicator tapered portion, and a length of the second indicator tapered portion in the direction orthogonal to the first direction decreases with increase in distance from the second wrapping portion, wherein the first indicator tapered portion and the second indicator tapered portion are symmetric with respect to the imaginary line, wherein one of opposite end portions of the first through portion which one is nearer to the first wrapping portion than the other comprises a first through-portion tapered portion having an angle of inclination which is equal to an angle of inclination of the first indicator tapered portion with respect to the first direction, and wherein one of opposite end portions of the second through portion which one is nearer to the second wrapping portion than the other comprises a second through-portion tapered portion having an angle of inclination which is equal to an angle of inclination of the second indicator tapered portion with respect to the first direction.

23. The label medium according to claim 22, wherein the line extends parallel with the first direction.

24. The label medium according to claim 23, wherein the first indicator portion and the second indicator portion are connected to each other via a first line, and wherein the first through portion and the second through portion are connected to each other via a second line, and the first line and the second line extend on an identical straight line.

25. The label medium according to claim 23, wherein only the first indicator portion and the second indicator portion are connected to each other via the line among the first indicator portion and the second indicator portion, the first wrapping portion and the second wrapping portion, and the first through portion and the second through portion.

26. The label medium according to claim 23, wherein at least a portion of the first indicator portion, at least a portion of the first wrapping portion, and at least a portion of the first through portion are aligned along a common axis parallel to the first direction, and wherein at least a portion of the second indicator portion, at least a portion of the second wrapping portion, and at least a portion of the second through portion are aligned along a common axis parallel to the first direction.

27. The label medium according to claim 22, wherein the line extends in a direction orthogonal to the first direction.

28. The label medium according to claim 27, wherein the first indicator portion and the second indicator portion are connected to each other via the line.

29. The label medium according to claim 27, wherein the first through portion and the second through portion are connected to each other via the line.

30. The label medium according to claim 27, wherein at least a portion of the first indicator portion, at least a portion of the second indicator portion, at least a portion of the first wrapping portion, at least a portion of the second wrapping portion, at least a portion of the first through portion, and at least a portion of the second through portion are aligned along a common axis parallel to the first direction.

31. The label medium according to claim 22, wherein a length of the first indicator portion in a direction orthogonal to the first direction is less than or equal to a length of the first hole or the first slit in the first direction, and wherein a length of the second indicator portion in the direction orthogonal to the first direction is less than or equal to a length of the second hole or the second slit in the first direction.

32. The label medium according to claim 31, wherein the length of the first hole or the first slit in the first direction is equal to the length of the first indicator portion in the direction orthogonal to the first direction, and wherein the length of the second hole or the second slit in the first direction is equal to the length of the second indicator portion in the direction orthogonal to the first direction.

33. The label medium according to claim 22, wherein a length of the first wrapping portion in a direction orthogonal to the first direction is less than or equal to a length of the first hole or the first slit in the direction orthogonal to the first direction, and wherein a length of the second wrapping portion in the direction orthogonal to the first direction is less than or equal to a length of the second hole or the second slit in the direction orthogonal to the first direction.

34. The label medium according to claim 33, wherein the length of the first hole or the first slit in the direction orthogonal to the first direction is equal to a length of the first wrapping portion in the direction orthogonal to the first direction, and wherein the length of the second hole or the second slit in the direction orthogonal to the first direction is equal to the length of the second wrapping portion in the direction orthogonal to the first direction.

35. The label medium according to claim 22, wherein the first wrapping portion is less than each of the first indicator portion and the first through portion in length in a direction orthogonal to the first direction, and wherein the second wrapping portion is less than each of the second indicator portion and the second through portion in length in the direction orthogonal to the first direction.

36. The label medium according to claim 22, wherein a shape and a size of the first indicator portion are respectively identical to a shape and a size of the second indicator portion, wherein a shape and a size of the first wrapping portion are respectively identical to a shape and a size of the second wrapping portion, and wherein a shape and a size of the first through portion are respectively identical to a shape and a size of the second through portion.

37. The label medium according to claim 22, wherein the first wrapping portion and at least a portion of the first hole or the first slit are aligned along a common axis parallel to the first direction, and wherein the second wrapping portion and at least a portion of the second hole or the second slit are aligned along a common axis parallel to the first direction.

38. A cassette containing a roll that is formed by winding the label medium according to claim 22 around a spool.

* * * * *